US009447548B2

(12) United States Patent
Penland, Jr.

(10) Patent No.: US 9,447,548 B2
(45) **Date of Patent: *Sep. 20, 2016**

(54) INDUSTRIAL MAT WITH MOLDED CORE AND OUTER ABUSE SURFACES

(71) Applicant: Joe Penland, Jr., Beaumont, TX (US)

(72) Inventor: Joe Penland, Jr., Beaumont, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/098,859

(22) Filed: Apr. 14, 2016

(65) Prior Publication Data

US 2016/0222597 A1 Aug. 4, 2016

Related U.S. Application Data

(63) Continuation-in-part of application No. 15/056,344, filed on Feb. 29, 2016, which is a continuation-in-part of application No. 14/839,900, filed on Aug. 28, 2015, now Pat. No. 9,315,951, application No. 15/098,859, (Continued)

(51) Int. Cl.

| | |
|---|---|
| ***E01C 9/08*** | (2006.01) |
| ***E01C 5/14*** | (2006.01) |
| ***E01C 5/18*** | (2006.01) |
| ***E01C 5/20*** | (2006.01) |

(52) U.S. Cl.

CPC ..... *E01C 9/086* (2013.01); *E01C 5/14* (2013.01); *E01C 5/18* (2013.01); *E01C 5/20* (2013.01)

(58) Field of Classification Search

CPC ..... E01C 9/086; E01C 9/08; E01C 5/00; E01C 5/14; E01C 11/24

See application file for complete search history.

(56) References Cited

U.S. PATENT DOCUMENTS

| | | | |
|---|---|---|---|
| 2,836,529 | A | 5/1958 | Morris |
| 4,462,712 | A | 7/1984 | Penland, Sr. |
| 4,629,358 | A | 12/1986 | Springston et al. |
| 4,889,444 | A | 12/1989 | Pouyer |
| 5,020,937 | A | 6/1991 | Pouyer |
| 5,139,845 | A | 8/1992 | Beckerman et al. |

(Continued)

FOREIGN PATENT DOCUMENTS

| | | | |
|---|---|---|---|
| CA | 2 233 776 | A1 | 12/1999 |
| EP | 2 705 950 | A1 | 3/2014 |

(Continued)

OTHER PUBLICATIONS

U.S. Appl. No. 14/839,900, Non-Final Rejection, Oct. 29, 2015.

(Continued)

*Primary Examiner* — Abigail A Risic
(74) *Attorney, Agent, or Firm* — Winston & Strawn LLP

(57) ABSTRACT

An industrial mat having a core construction that provides strength and rigidity to the mat, an encapsulation of a durable skin of a thermoplastic, thermosetting or elastomeric material that surrounds the core construction, and upper and/or lower surfaces formed by a plurality of elongated members. The elongated members of the upper and/or lower surfaces are advantageously arranged in spaced relation in at least one layer and are attached together or to the core construction for protecting the durable skin from abrasion and impact during transport, installation and use of the industrial mat. The resulting industrial mat has a load bearing capacity that is able to withstand a load of at least 600 to 1000 psi without permanent deformation. The mats of the invention typically have a width of 2 to 12 feet, a length of 2 to 40 feet and an overall thickness of 2 to 18 inches.

25 Claims, 6 Drawing Sheets

Related U.S. Application Data which is a continuation-in-part of application No. 14/855,336, filed on Sep. 15, 2015.

(60) Provisional application No. 62/052,954, filed on Sep. 19, 2014, provisional application No. 62/159,909, filed on May 11, 2015, provisional application No. 62/211,664, filed on Aug. 28, 2015, provisional application No. 62/259,301, filed on Nov. 24, 2015.

(56) References Cited

U.S. PATENT DOCUMENTS

| | | | | |
|---|---|---|---|---|
| 5,163,776 | A | 11/1992 | Pouyer | |
| 5,273,373 | A * | 12/1993 | Pouyer | E01C 9/086 404/35 |
| 5,342,260 | A | 8/1994 | Markland | |
| 5,653,551 | A | 8/1997 | Seaux | |
| 5,822,944 | A | 10/1998 | Penland, Sr. | |
| 5,888,612 | A | 3/1999 | Needham et al. | |
| 6,214,428 | B1 | 4/2001 | Henderson | |
| 6,231,994 | B1 | 5/2001 | Totten | |
| 6,380,309 | B1 | 4/2002 | Parker et al. | |
| 6,474,905 | B1 | 11/2002 | Smith, Jr. | |
| 6,497,956 | B1 | 12/2002 | Phillips et al. | |
| 6,511,257 | B1 | 1/2003 | Seaux et al. | |
| 6,649,110 | B1 | 11/2003 | Seaux et al. | |
| 6,662,508 | B1 | 12/2003 | Else | |
| 6,695,527 | B2 | 2/2004 | Seaux et al. | |
| 6,722,831 | B2 | 4/2004 | Rogers et al. | |
| 6,821,623 | B2 | 11/2004 | Kvesic | |
| 7,137,226 | B2 | 11/2006 | Fiutak et al. | |
| 7,303,800 | B2 | 12/2007 | Rogers | |
| 7,404,690 | B2 * | 7/2008 | Lukasik | E01C 5/18 404/29 |
| 7,413,374 | B2 | 8/2008 | Rogers et al. | |
| 7,427,172 | B2 | 9/2008 | Lukasik | |
| D609,956 | S | 2/2010 | Lukasik | |
| 7,818,929 | B2 | 10/2010 | Fiutak et al. | |
| 7,934,885 | B2 | 5/2011 | Fournier | |
| 8,061,929 | B2 | 11/2011 | Dagesse | |
| 8,088,477 | B2 | 1/2012 | Curtis et al. | |
| 8,382,393 | B1 | 2/2013 | Phillips | |
| 8,613,373 | B2 | 12/2013 | Holtby et al. | |
| 8,784,001 | B1 | 7/2014 | Phillips | |
| 8,906,480 | B2 | 12/2014 | Fiutak et al. | |
| 8,936,073 | B1 | 1/2015 | Phillips | |
| 9,133,598 | B2 | 9/2015 | Hsu | |
| 2002/0110418 | A1 | 8/2002 | Renick | |
| 2004/0037644 | A1 * | 2/2004 | Renick | E01C 9/086 404/35 |
| 2004/0071914 | A1 | 4/2004 | Fiutak et al. | |
| 2004/0253055 | A1 | 12/2004 | Polivka, Jr. | |
| 2005/0022363 | A1 | 2/2005 | Harrison | |
| 2006/0265976 | A1 | 11/2006 | Fiutak | |
| 2007/0056228 | A1 | 3/2007 | Penland, Sr. et al. | |
| 2007/0237581 | A1 | 10/2007 | Lukasik et al. | |
| 2008/0028703 | A1 | 2/2008 | Brandstorm | |
| 2008/0085154 | A1 * | 4/2008 | Lukasik | E01C 5/18 404/35 |
| 2008/0152861 | A1 | 6/2008 | Barker | |
| 2008/0292397 | A1 | 11/2008 | Farney et al. | |
| 2009/0087261 | A1 | 4/2009 | Fournier | |
| 2009/0301004 | A1 | 12/2009 | Dagesse | |
| 2011/0233363 | A1 | 9/2011 | Wold | |
| 2011/0280657 | A1 | 11/2011 | Martinez | |
| 2012/0063844 | A1 | 3/2012 | Wold | |
| 2013/0306804 | A1 | 11/2013 | Holtby et al. | |
| 2013/0318896 | A1 * | 12/2013 | Rogers | E01C 9/08 52/223.7 |
| 2014/0154462 | A1 | 6/2014 | Fiutak et al. | |
| 2014/0193196 | A1 | 7/2014 | Fournier | |
| 2014/0199119 | A1 | 7/2014 | Stasiewich | |
| 2014/0205377 | A1 * | 7/2014 | Hill | E21B 41/00 404/35 |
| 2014/0341649 | A1 | 11/2014 | Bryan et al. | |

FOREIGN PATENT DOCUMENTS

| | | | |
|---|---|---|---|
| WO | 95/25076 | A1 | 9/1995 |
| WO | 2006/002507 | A1 | 1/2006 |
| WO | 2006/048654 | A1 | 5/2006 |
| WO | 2007/112537 | A1 | 10/2007 |

OTHER PUBLICATIONS

U.S. Appl. No. 14/839,900, Notice of Allowance, Jan. 20, 2016.
U.S. Appl. No. 14/855,336, Non-Final Rejection, Feb. 9, 2016.
Forest Products Laboratory. Wood Handbook—Wood as an Engineering Material—4. Mechanical Properties of Wood. U.S. Department of Agriculture. Online version available at: app.knovel.com/hotlink/pdf/id:kt0052LP04/wood-handbook-wood-an/mechanical-properties (1999).
"Inflammable". Wiktionary. Archived Sep. 6, 2014.
International Search Report and Written Opinion, Appl. No. PCT/US2016/020081, Jun. 2, 2016.

* cited by examiner

CHEVRON

HERRINGBONE

INDUSTRIAL MAT WITH MOLDED CORE AND OUTER ABUSE SURFACES

CROSS-REFERENCE TO RELATED APPLICATIONS

This application is a continuation-in-part of U.S. application Ser. No. 15/056,344 filed Feb. 29, 2016, which is a continuation-in-part of U.S. application Ser. No. 14/839,900 filed Aug. 28, 2015, now U.S. Pat. No. 9,315,951, which claims the benefit of application No. 62/052,954 filed Sep. 19, 2014. This application is also a continuation-in-part of U.S. application Ser. No. 14/855,336 filed Sep. 15, 2015. This application also claims the benefit of U.S. provisional applications No. 62/159,909 filed May 11, 2015, 62/211,664 filed Aug. 28, 2015 and 62/259,301 filed Nov. 24, 2015. The entire content of each of the foregoing applications is expressly incorporated herein by reference thereto.

BACKGROUND

The present invention relates to a reusable system for the construction of roadways and equipment support surfaces in areas having poor ground integrity characteristics. More particularly, the present invention relates to a system of durable mats which can be interconnected to form roadways and/or equipment support surfaces. More particularly still, the present invention relates to a reusable system of mats which can be quickly and easily positioned in a single layer to form roadways and/or equipment support surfaces, and which can thereafter be easily removed and stored until needed again.

Mats for this use are generally known in the art and are available from Quality Mat Company, Beaumont, Tex. In remote and unstable environments, a stable roadway (or any roadway) often does not exist, such that temporary roadways are assembled by aligning planks, boards or mats along the desired path. The mats provide temporary structures for various construction projects as well as for use in environmental or disaster cleanup projects. These mats enable trucks and other equipment to drive over, store equipment on, or create campsites on otherwise unstable, soft or moist land or damaged areas by providing a relatively level and stable surface.

While conventional wood mats provide useful service at a reasonable cost, the wood core, which is typically made of white oak, can deteriorate over time due to moisture causing gradual rotting and degradation of the wood material. This causes the mat to be discarded, because unlike some of the other materials that are used on the upper and lower layers of the mat, the core cannot be replaced without essentially making an entirely new mat.

While various mats exist for such uses, there is a need for mats having improved resistance to wood deterioration as well as to abuse of and damage to the mats in order to extend their service lives. The present invention now provides new mat constructions that meet this need.

SUMMARY OF THE INVENTION

The invention relates to an industrial mat comprising a core construction that provides strength and rigidity to the mat, an encapsulation of a durable skin of a thermoplastic, thermosetting or elastomeric material or a mixture thereof that surrounds and encapsulates the core construction, with the skin forming top and bottom surfaces about the core construction and having a thickness sufficient to provide environmental resistance to the core construction that it encapsulates; and either an upper surface formed by a plurality of elongated members positioned above the encapsulated core construction, a lower surface formed by a plurality of elongated members positioned below the encapsulated core construction, or both of the upper and lower surfaces. The elongated members of the upper and/or lower surfaces are advantageously arranged in spaced relation in at least one layer and are attached together or to the core construction for protecting the durable skin from abrasion and impact during transport, installation and use of the industrial mat. The resulting industrial mat has a load bearing capacity that is able to withstand a load of at least 600 to 800 or even to 1000 psi without permanent deformation. The mats of the invention typically have a width of between about 2 and about 12 feet, a length of between about 2 and about 40 feet and an overall thickness of between about 2 and about 18 inches.

The core construction generally comprises:

(a) at least one layer or ply of a wood or engineered wood sheet member or of wood or engineered wood elongated components that are fastened or joined together, or (b) a layer or ply of a thermoplastic material in the form of a plurality of adjacently arranged elongated members or a sheet member that optionally includes open or closed cells therein or therethrough, or (c) a thermosetting plastic support structure in the form of a plate, beam, grid, grating, ladder or pultruded tubes, or (d) a metal support structure in the form of beams that are welded together to form a frame or ladder structure, or a plate that optionally contains apertures therein, or (e) at least two layers or plies of elongated, sheet, plate, beam, grid, grating, ladder or tube members wherein the layers or plies are fastened or joined together.

Preferably, the core construction includes a central layer of one of (a), (b), (c) or (d), and either an upper layer positioned above the central layer or a lower layer positioned below the central layer or both upper and lower layers, wherein each upper and/or lower layer is attached to the central layer and includes a plurality of elongated members of wood or engineered wood, each elongated member having a modulus of at least about 1.6 M psi.

The encapsulated core construction can have various lengths and widths. In one embodiment, the encapsulated core construction can have a length and width that substantially corresponds to that of the mat. For this, the encapsulated core construction has a thickness of not less than about 0.75 inches and not more than about 12 inches or between about 1 and about 8 inches or between about 1.5 and about 4 inches.

In another embodiment, the mat has a length and width that is smaller than that of the mat by about 4 to about 16 inches so that the encapsulated core construction is recessed from an end, side or both end(s) and side(s) of the mat. Additionally, one of the upper surface or the lower surface may include elongated members that are of the same thickness as the encapsulated core construction and that are arranged and attached along the periphery of the mat at a front end thereof, a back end thereof, one or both sides thereof or on combinations of or all of the front end, back end and sides of the encapsulated core construction to provide in the final mat a peripheral structure to protect the encapsulated core construction from side and/or end impact.

In other embodiments, such as when the encapsulated core structure has essentially the same width and length as the upper and lower surfaces, the mat may include bumper members located along the periphery of the mat at a front end thereof, a back end thereof, one or both sides thereof or on combinations of or all of the front end, back end and sides of the core construction and connected thereto to protect the encapsulated core construction from side and/or end impact.

Also, for any of these embodiments, the encapsulated core construction may be made as a single component or in multiple sections that when placed adjacent each other form the overall encapsulated core construction The can facilitate manufacture of the encapsulated core construction in smaller sections that typically represent ½, ⅓, ¼ or any other reasonable portion of the overall length and width that of the mat.

The encapsulation generally comprises a thermoplastic material, preferably of polyethylene, polypropylene, polybutylene or a thermoplastic polyurethane, or a thermosetting material such as a polyurethane, or an elastomeric material preferably of a vulcanized rubber material. A typical encapsulation thickness ranges from a minimum thickness of about 0.25 inch to a maximum thickness of about 7 inches but this can vary depending upon the specific mat construction and can be about 0.5, about 1, about 1.5, about 2, about 3, about 4, about 5, about 6 or about 7 inches. A most preferred encapsulation comprises a mixture of an elastomeric material and a polyurethane resin, wherein the elastomeric material comprises crumb rubber particles embedded in a matrix of the polyurethane resin, with the crumb rubber particles comprising at least about 55 to about 80% by weight of the encapsulation and the polyurethane comprising about 20 to about 45% by weight of the encapsulation.

The upper surface, the lower surface or both the upper and lower surfaces may include one or multiple layers or plies of elongated members. These surfaces can be made of 2 or 3 ply mats as well. The elongated members generally comprise boards, sheets or plates of wood, engineered wood, a thermoplastic, a thermosetting plastic, an elastomer or a recycled material of any of the foregoing with a binder. These elongated members are bolted, riveted or screwed to the core construction to form the mat.

In a preferred embodiment, the elongated members of the upper surface, the lower surface, or both the upper and lower surfaces are arranged in a spaced longitudinal arrangement in an outermost layer to form a plurality of channels or grooves therein that provide traction to objects moving on the upper surface of the mat and/or resistance to mat slippage when the lower surface of the mat is placed on wet or muddy ground surfaces. These channels or grooves are about 0.5 to about 2 inches wide, about 0.25 to about 2 inches deep and extend along or across the mat.

One or more lifting elements may be attached to the upper surface, the lower surface, or to each surface, with the lifting elements comprising D-shaped members, O-shaped members, U-shaped members, hooks, or circular or polygonal rings having sufficient strength to provide certified overhead lifting of the mat for installation and reclamation thereof.

BRIEF DESCRIPTION OF THE DRAWINGS

The appended drawing figures provide additional details of the invention, wherein.

DETAILED DESCRIPTION OF THE INVENTION

Figure 1:
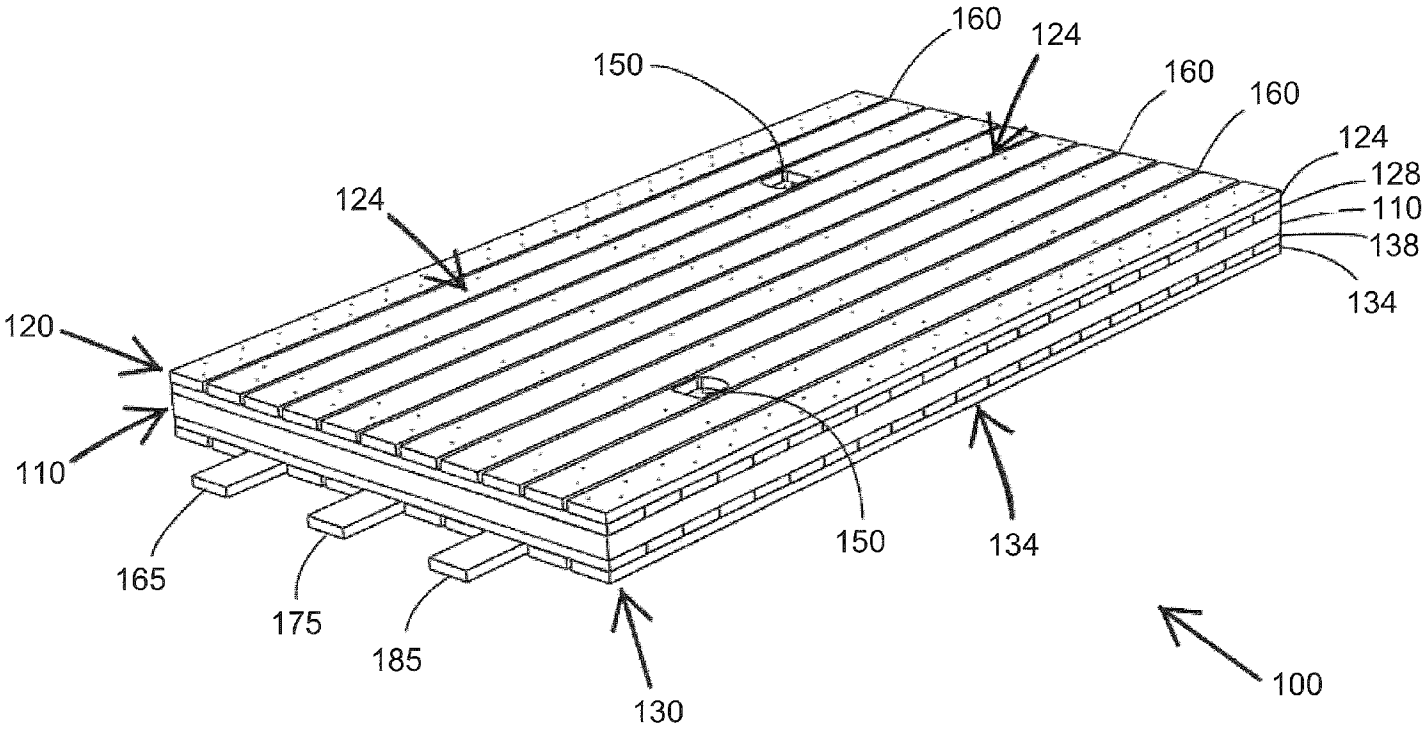
FIG. 1 is perspective view of an industrial mat according to the present invention.

The present invention now provides an improved mat that possesses better environmental resistance due to the provision of an encapsulation that surrounds the wood components of the mat or the entire core construction of the mat. The encapsulation is made of an environmentally resistant material. The term "environmentally resistant material" means a material that is not subject to deterioration by water, moisture or other environmental conditions when compared to a conventional wood material such as white oak that is commonly used for such mats. This term includes thermoplastic and thermosetting materials as disclosed herein along with various elastomeric or rubber materials.

Certain terms that are used herein are defined hereinbelow to assist in the understanding of the invention.

The term "industrial mat" is intended to cover relatively large mats having widths of at least about 4 feet with lengths running from about 4 feet to 40 feet and incorporating elongated members, beams or other components having square or rectangular cross sections of sizes of at least about 1×6 to 8×8 inches with lengths from about 4 feet to as much as 40 feet or more. As noted, previous and current mats of this type that are commercially available are primarily constructed of monolithic wood.

The term "substantially" is used for its ordinary meaning to indicate that the dimensions are not precise or exact. A skilled artisan can readily determine what tolerances are acceptable to provide a surface that is considered to be flat based upon the size of the side beams and the type of service that the mat is expected to provide. There is no requirement that the beams and elongated members be flush with each other along the top and bottom surfaces of the mat. Typically, the term "substantially' will mean that the top surfaces of the beams and elongated members can vary by as much as a few inches although in the more preferred embodiments the variance is less than 1 inch.

Additionally, all dimensions recited herein are approximate and can vary by as much as ±10% to in some case ±20 or 25%. In some situations, the term "about" is used to indicate this tolerance. And when the term "about" is used before reciting a range, it is understood that the term is applicable to each recited value in the range. Often, the craftsmanship and engineering procedures that are followed in construction of these mats minimize these tolerances as much as possible or industrially practical.

In one embodiment, the present invention provides an improved mat that possesses structural integrity based on the properties and configuration of the core construction as well as environmental resistance provided by the encapsulation and abuse and abrasion resistance from the upper and lower surfaces of elongated members.

In one embodiment, the encapsulation, also referred to as an encasement, typically includes two pieces, an upper portion and a lower portion, each generally representing half of the encapsulation. The encapsulation will be formed to allow the core construction to be completely accommodated therein, with half of the core being fit within the upper portion and half fit in the lower portion. The tolerance variation for the core construction is ±⅛" and preferably ±1/16" for all dimensions so that it will easily be received within the encapsulation. Once the core is placed inside the encapsulation, the top and bottom portions will be sealed or joined together to completely enclose the core therein.

In another embodiment, the encapsulation material is preferably a high density polyethylene made by a manufacturing process known as sheetless thermoforming technology (STF). The resulting mat is preferably an engineered wood product mat encapsulated in a sealed thermoplastic encasement. The primary advantage of this product is preservation of the wood structure contained inside as it is sealed off from the elements prior to experiencing environmental conditions during use at a jobsite.

In yet another embodiment, the encapsulation can be provided by placing the core construction in a mold and introducing the encapsulation material into the mold and in and around the core construction.

The encapsulation is preferably an environmentally resistant material to protect the core construction from degradation due to weather conditions, typically moisture or water from rain or snow, as well as contact with oil, gas or other chemicals. If the mats are to be used in a particular chemical environment, the encapsulation materials can be selected for resistance against that environment. Generally, however, the encapsulation material is one that can provide water and moisture resistance for the materials that are used for the core construction. Also, the encapsulation material shall be chemically resistant to typical liquids found in the construction site. Thus, the mat will not absorb liquid contaminates so that after cleaning or washing, the mat can be removed from the work site without transporting liquid contaminates.

A wide range of polymeric materials can be used for the encapsulation of the invention. These materials include:

Acrylonitrile butadiene styrene (ABS)
Acrylic (PMA)
Celluloid
Cellulose acetate
Cyclo olefin Copolymer (COC)
Ethylene-Vinyl Acetate (EVA)
Ethylene vinyl alcohol (EVOH)
Fluoroplastics (PTFE, alongside with FEP, PFA, CTFE, ECTFE, ETFE)
Ionomers
Kydex, a trademarked acrylic/PVC alloy
Liquid Crystal Polymer (LCP)
Polyacetal (POM or Acetal)
Polyacrylates (Acrylic)
Polyacrylonitrile (PAN or Acrylonitrile)
Polyamide (PA or Nylon)
Polyamide-imide (PAI)
Polyaryletherketone (PAEK or Ketone)
Polybutadiene (PBD)
Polybutylene (PB)
Polybutylene terephthalate (PBT)
Polycaprolactone (PCI)
Polychlorotrifluoroethylene (PCTFE)
Polyethylene terephthalate (PET)
Polycyclohexylene dimethylene terephthalate (PC (PC)T)
Polycarbonate
Polyhydroxyalkanoates (PHAs)
Polyketone (PK)
Polyethylene (PE)
Polyetheretherketone (PEEK)
Polyetherketoneketone (PEKK)
Polyetherimide (PEI)
Polyethersulfone (PES)—see Polysulfone
Polyethylenechlorinates (PEC)
Polyimide (PI)
Polylactic acid (PLA)
Polymethylpentene (PMP)
Polyphenylene oxide (PPO)
Polyphenylene sulfide (PPS)
Polyphthalamide (PPA)
Polypropylene (PP)
Polystyrene (PS)
Polysulfone (PSU)
Polytrimethylene terephthalate (PTT)
Polyurethane (PU)
Polysulfone (PSU)
Polytrimethylene terephthalate (PTT)
Polyvinyl chloride (PVC)
Polyvinylidene chloride (PVDC)
Styrene-acrylonitrile (SAN)

The preferred materials are those that are moldable to form the upper and lower portions of the encapsulation, as well as those that are weldable or otherwise capable of being adhered, sealed or otherwise merged together so that the core construction can be fully encapsulated and sealed from environmental conditions.

As noted, the encapsulation may molded into upper and lower portions, which are preferably identical. These portions are configured to be placed upon the upper and lower layers of the core construction. To facilitate placement of the upper and lower portions on the core construction, the components used for constructing the core are made of engineered lumber or processed white oak in order to provide close tolerances of around ±⅛$^{th}$ of an inch or less and typically around 1/16$^{th}$ of an inch. This assures that the upper and lower portions of the encapsulation will fit properly and snugly on the core construction with the peripheries of the upper and lower portions in contact so that they can be joined together by welding, adhesives, additional molding or other techniques that join and seal the portions together. This assures the complete encapsulation of the construction core in order to prevent egress of water, moisture, chemicals or other solutions that will over time cause degradation of the wood materials.

Alternatively, the encapsulation can be provided in other ways, including but not limited to immersion coating of the entire core construction into the encapsulation material, or by painting or otherwise depositing encapsulation material on all surfaces and sides of the core construction to completely encapsulate it. The encapsulation material is typically a thermoplastic polymer, a thermosetting resin or an elastomeric material. For example, the entire core construction can be coated with a thermoplastic or thermosetting resin to form a solid unitary mat structure.

One method of preparation includes placing the core construction in an enclosure and applying a liquid plastic or elastomeric material to the core construction in the enclosure in an amount sufficient to form the encapsulation as the outermost surfaces of the mat and at a thickness sufficient to protect the core construction from environmental conditions.

The enclosure is a large box or mold that can receive the core construction therein and to provide a housing for applying the plastic material therein. In one embodiment, the core construction is suspended in the enclosure and the liquid plastic is applied by spraying, painting, troweling or even pouring the plastic material onto and about the core construction.

The core construction can be suspended by being placed on supporting structures such as cones, inverted cones, pins, or rods that hold the core construction in a desired position. The cones, pins or rods are arranged throughout the bottom of the core construction and are attached thereto to evenly support it in the mold in order to provide the desired uniform spacing above, below and around it. These supports typically have a height of between about 0.25 and about 1" as they determine the thickness of the lower surface of the final mat. They are typically made of the same material as the encapsulation material so that it bond to the liquid encapsulation material and remain in the encapsulation in the final mat.

In a preferred embodiment, the supporting structures are inverted cones that has their apexes contacting the base of the mold. These cones can be made of the same material as the plastic that is to encapsulate the core or of a higher melting point material so that they do not change shape or melt when contacted by the liquid plastic that is added. The base of each cone is attached to the core by an adhesive or a fastener (screw, nail or rivet) with sufficient cones provided so that the core is securely and uniformly supported in the mold. When the plastic material is introduced into the mold, it can flow around the cones and provide a bottom surface of the mat that only has very small dots where the cone apexes contact the bottom of the mold. This provides a much better appearance than when the cone base (or a rod or cylinder) contacts the mold. And as the cones are made of the same material as the encapsulation, they blend together well in the final mat.

Alternatively, the core construction can be suspended from a wire or cord that holds the core construction in the appropriate position in the enclosure. The wire or cord is preferably made of a material that is environmentally resistant, e.g., an engineering plastic such as nylon or a rust resistant metal such as aluminum or stainless steel which again can remain in the encapsulation after the mat is made because such materials do not detract from the environmental resistance of the mat.

In another embodiment, the enclosure is a mold that is configured and dimensioned to provide a generally uniform spacing around the core construction that is suspended therein, and the liquid plastic material can be added into the mold and around the core construction to form the encapsulation around the core construction. The liquid encapsulation material (i.e., plastic or elastomer) is provided in an amount that forms a thickness of the outermost surfaces of the encapsulation that is at least about 0.25 to about 0.5 inch although it can be as thick as about 1 inch or greater if desired. As an example, the mold can be 8'1.5" by 12'1.5" so that it can receive a two layer wood frame that is 8' by 12'. The wood frame can be suspended about 0.75" above the bottom of the mold so that the outer surfaces of the resulting encapsulation will have a thickness on the order of about 0.75".

The upper portion of the mold is typically open and includes markings as a fill line to indicate the upper level of the added liquid encapsulation material. Also, the base of the mold is typically movable in particular upwards for assisting in ejecting the final mat from the mold after formation. The sides of the mold can be configured with very smooth surfaces or with a mold release agent to assist in allowing the mat to be ejected from the mold. A simple solution is to line all surfaces of the mold with a film of a plastic such as mylar that does not adhere strongly to the mold and that can form the outermost surfaces of the mat. When a molten encapsulation material is used, such as a molten plastic, the film can be selected to be able to resist the temperature of the molten plastic so that the final mat can easily be disengaged from the mold.

It is also possible to provide greater spacing so that the encapsulation material has a thickness of 2" to 6" at least on the elongated sides of the core construction. This thickness provides "bumpers" along the edges of the mat to prevent against damage of the core construction during use. For example, core construction of wood boards that is 7' by 11' by 4.5" thick can be placed in a mold that is 8' by 12' and 8" deep to form 6" bumpers around the mat and upper and lower encapsulation thicknesses that are each 1.75" in thickness.

One way to form the encapsulation is to fill the mold with the liquid encapsulation material so that the core construction is immersed into the liquid. This assures that all surfaces of the mat as well as at least some or most of the interstices of the core construction are provided with the plastic material that forms the encapsulation. The mold can be made of metal which is heated to soften and convert the encapsulation material to a more flowable liquid form. Alternatively, a solid or semisolid encapsulation material can be placed into the mold and heated to become softened so that the core construction can be placed onto the softened material to be embedded therein. Additional encapsulation material can be placed on the top of the core or frame construction to complete the encapsulation. These materials can be in sheet form that are heated before being placed in the mold. One sheet can be placed below the core construction and one above it. The softened sheets conform to the core construction and the edges stick together to complete the encapsulation.

For certain materials, such as thermosetting plastics, the heating of the mold will accelerate the cure of the material to more quickly form the final mat, Of course, the temperature would not be increased too high to reduce the setting time to one that would not allow a complete immersion of the mat of that would prevent the material from entering into the interstices of the mat.

Alternatively, if desired for certain materials, the mold can be cooled to assist in solidifying the encapsulation material that is injected into the mold. This would reduce the time for forming a mat when a molten plastic is used.

For either embodiment, the mold can be made in different movable sections so that after the encapsulation material forms a solid encapsulation, the mold sections can be moved apart or separated to recover the encapsulated mat from the mold.

Any one of a wide variety of plastic materials can be used in this method, including any one of the thermoplastic materials mentioned herein.

In another embodiment, the plastic material may be a liquid thermosetting plastic material that includes an activator or curing agent so that the liquid can be applied to the frame construction prior to hardening and setting to form the encapsulation. These thermosetting polymers form irreversible chemical bonds during the curing process. Thermosets do not melt, but decompose and do not reform upon cooling, so that once the encapsulation is formed around the core construction, it provides a very strong and durable encasement. Preferred thermoset materials include Epoxy, Melamine formaldehyde (MF), Phenol-formaldehyde (PF), Polyester, Polyurethane (PU), Polyimide (PI), Silicone (SI) or Urea formaldehyde (UF). These materials can be reinforced with fibers or filler (carbon, glass, metal, etc.) if desired. Thus, the core construction can be coated with a thermosetting resin to form a solid unitary encapsulated mat structure. Instead of coating, the resin can instead be applied by painting or spraying. Also, the liquid resin can be placed in the mold either before or after introduction of the core construction therein. The supports for the mat can be thermosetting or thermoplastic materials that end up becoming part of the encapsulation of the mat. And as noted herein, providing a metal mold would allow the mold to be heated to assist in curing of the thermosetting material.

Elastomeric materials that are useful for the encapsulation include:

Unsaturated rubbers that can be cured by sulfur vulcanization—these are preferred from a strength and hardness standpoint:

Natural polyisoprene: cis-1,4-polyisoprene natural rubber and trans-1,4-polyisoprene gutta-percha;

Synthetic polyisoprene;

Polybutadiene;

Chloropene rubber, i.e., polychloroprene;

Butyl rubber (i.e., copolymer of isobutylene and isoprene) including halogenated butyl rubbers (chloro butyl rubber; bromo butyl rubber);

Styrene-butadiene Rubber (copolymer of styrene and butadiene); and

Nitrile rubber (copolymer of butadiene and acrylonitrile).

Saturated (non-vulcanizable) rubbers include:

Ethylene propylene rubber (EPM);

Ethylene propylene diene rubber (EPDM);

Epichlorohydrin rubber;

Polyacrylic rubber;

Silicone rubber;

Fluorosilicone Rubber;

Fluoroelastomers;

Perfluoroelastomers;

Polyether block amides; and

Chlorosulfonated polyethylene.

The elastomeric and thermoplastic materials disclosed herein can also be provided with conventional filler materials to increase weight and hardness. They also can be reinforced with fiberglass, other fibers, fabric or metal sheets, screening or scrim to reduce elongation and provide greater rigidity.

The heating of the mold can assist in the curing of those elastomeric materials that require vulcanization or other additives that facilitate curing.

A preferred type of elastomeric or rubber material is crumb rubber which is prepared by grinding worn or discarded rubber vehicle tires. A commercially available version of this material is typically prepared by grinding worn or discarded rubber vehicle tires to provide rubber particles. During the recycling process steel and tire cord (fluff) is removed, leaving tire rubber particles that have a granular consistency. Continued processing reduces the size of the particles further. The particles are sized and classified based on various criteria including color (black only or black and white). The granulate is sized by passing through a screen, with the size based on a dimension or mesh. The particular size for the crumb rubber of the invention is that which is between about 0.1 and about 0.4 inches and the particles are generally uniform and are within that range. These sizes maximize the area of interaction with the polyurethane to provide optimum properties to the encapsulation.

These particles can be mixed with a thermoplastic or thermosetting polyurethane forming mixture and set or cured in place to form the encapsulation around the mat. The crumb rubber encapsulation disclosed herein can also be provided with conventional filler materials to increase weight, strength or hardness. These can be added to the crumb rubber particles prior to contacting the polyurethane forming component. In some embodiments, the reinforcing materials can be added to the polyurethane forming component after contact with the crumb rubber. This can be achieved by arranging the crumb rubber particles and reinforcing material in the mold prior to introducing the polyurethane forming material therein. The reinforcing materials include inorganic particulates such as silica, alumina, mica or even sand or fine gravel, fiberglass or other fibers, or fabric or metal sheets, screening or scrim. These materials reduce elongation and provide greater rigidity to the polyurethane matrix that surrounds the crumb rubber.

The crumb rubber particles are preferably held in the encapsulation by being embedded in a polyurethane matric or binder. Polyurethane is a polymer composed of a chain of organic units joined by carbamate (urethane) links. While most polyurethanes are thermosetting polymers that do not melt when heated, thermoplastic polyurethanes are also available and either one can be used in the encapsulations disclosed herein. The thermosetting polymers are preferred for use because they are generally harder and less subject to degradation or deterioration from high temperatures. These polymers are traditionally and most commonly formed by reacting a di- or polyisocyanate with a polyol. Both the isocyanates and polyols used to make polyurethanes contain on average two or more functional groups per molecule. Any polyol and isocyanate can be used herein although it is preferred that the resulting polyurethane polymer or resin be one that has good impact and abrasion resistance and a medium hardness so that it can withstand vehicle movement thereover or equipment place thereupon without permanently deforming. Routine tests can be conducted to determine the optimum polyurethane resin (i.e., the isocyanate and polyol components) for any particular industrial mat application.

The encapsulation protects the core construction from degradation due to weather conditions, typically moisture or water from rain or snow, as well as contact with oil, gas or other chemicals. Also, the encapsulation will not absorb liquid contaminates so that after cleaning or washing, the mat can be removed from the work site without transporting liquid contaminates.

The encapsulation can be provided by other techniques as well. For encapsulating a wood mat, a mold can be prepared with a bottom surface that is configured to mimic the bottom surface of the two or three ply wood mat. The bottom surface of the mold is connected to side portions to form a well. In the particular configuration desired for a conventional three ply wood mat, the bottom surface of the mat has three elongated openings which can receive three external boards that are configured in an offset manner in order to allow interconnection of one mat with an adjacent mat.

The sides of the mold are smooth and essentially vertical. A slight draft angle may be provided to assist in removing the mat from the mold after the polyurethane sets and cures. In particular, the draft angles are a few degrees (i.e., 2 to 7) off vertical and extend outward such that the sidewalls are preferably placed at an angle of 92 or 93° with respect to the base or lower portion of the mold.

The top surface of the mold is a separate plate that is configured in a like manner as the bottom surface of the mold to provide the appropriate surface contour on the top of the mat as the lower mold surface provides on the bottom of the mat. The top and bottom mold surfaces may be configured to provide additional surface features, such as drainage channels, recesses for lifting elements, or openings for other peripherals. These water removal channels are provided and are imparted into the top or bottom surface of the encapsulation because they are configured as raised areas in the mold plate. These are preferably utilized on the surface of the core construction that is not provided with the exposed elongated members.

The mold well is first filled with approximately 0.5 to 2.5 inches of crumb rubber particles. The mold may include a fill line or other markings to indicate the upper level of the rubber crumb particulate matter that is to be introduced into the well. The crumb rubber can be added to the mold in many ways, such as with use of an air blower and pipe connected to a supply of the crumb rubber particles. Of course, the particulate matter can simply be dumped in the mold from pails or other sources to fill the mold well to the appropriate level.

Thereafter, the mat is placed into the mold with the bottom surface facing the crumb rubber. The bottom surface of the mat is also provided with positioning pins so that it is supported approximately 0.25 to 2 inches above the lower mold surface. These positioning pins can take many different forms. In one arrangement, these pins can be cones or other protrusions extending from the bottom surface of the mat. In a preferred arrangement, these pins are bolts that are screwed into holes in the mat that extend the desired distance away from the bottom of the mat so that it can be placed and situated properly in the mold. These bolts are connected to threaded openings that will later receive bolts to secure the three offset boards that are used to interconnect one mat to an adjacent mat. A sufficient number of positioning pins will be provided to properly set the mat into the mold. For a mat that is 14 feet long, at least five to seven positioning pins will be used on each location where a board will be attached for interconnection of the mat. This results in at least 15 to 21 positioning pins being provided for properly placing the mat at the correct position in the mold. The weight of the mat generally enables the pins to contact the bottom mold surface but if not the later closing of the mold will urge the mat downwardly until the pins contact the bottom mold surface.

When the mat does not have interlocking boards or other interlocking structures, the core construction can include inverted cones that has their apexes contacting the base of the structure for positioning the mat in the mold. These cones can be made of the same material as the polyurethane matrix or resin that is to encapsulate the core construction. The base of each cone is attached to the core construction by an adhesive or a fastener (screw, nail or rivet) with sufficient cones provided so that the core construction is securely and uniformly supported in the mold. When the polyurethane forming mixture is introduced into the mold, it can flow around the cones and provide a bottom surface of the mat that only has very small dots where the cone apexes contact the bottom of the mold. This provides a much better appearance than when the cone base (or a rod, bolt or cylinder) contacts the mold. And as the cones are made of the same material as the encapsulation matrix, they blend together well in the final encapsulated mat.

After the mat is positioned in the mold, it is then covered with an additional 0.5 to 2.5 inch layer of rubber crumbs which will be used to form the top surface of the encapsulation of the mat. The crumb material also is provided between the sides of the mold and the mat to provide the side encapsulation. For this the mold is configured to be 1 to 4 inches wider than the width of the mat. Alternatively, pins or spacers can be used to center the mat in the mold. Thereafter, the upper mold surface is placed upon the rubber crumb layer and is clamped in position so that the final encapsulation thickness is controlled to the desired value. The top surface of the mat can also be provided with pins in the same manner as the bottom surface so that the mat is precisely positioned between the top and bottom mold surfaces. This assures that the encapsulated mat will have an encapsulation of between at least 0.25 and 2 inches on both the top and bottom surfaces as well as the sides of the mat. The amount of polyurethane components are provided so that the encapsulation typically comprises about 55 to about 80% by weight of crumb rubber and about 20 to about 45% by weight of polyurethane.

As a specific example, the mold can be 8 feet 1.5 inches by 12 feet 1.5 inches so that it can receive a two layer wood frame that is 8 feet by 12 feet. The wood frame can be placed about 1 inch above the bottom of the mold and about 1 inch below the top mold plate so that the outer surfaces of the resulting encapsulation will have a thickness on the order of 1 inch.

Conventional internal or external mold release agents can be applied to all mold surfaces prior to starting the process in order to assure a fast release of the encapsulated mat out of the mold after the mixture has fully set and cured. These agents are generally fluorocarbon based. Alternatively, all surfaces of the mold can be provided with a paper layer or plastic film so that the polyurethane does not adhere to the mold.

After the mold is secured in position, the polyurethane forming components, i.e., a polyol/isocyanate mixture, is introduced into the mold. The resin can be introduced into different sections of the mold at a number of locations. As the mixture has a relatively low viscosity, it will fill in all voids between the crumb rubber particles and the mat or mold surfaces as well as being able to flow throughout the rubber crumb layers to saturate each particle and the spaces around it. After the mixture sets and cures, the rubber crumb particles are embedded in the final polyurethane matrix that is formed. If desired, the mold can include vacuum lines that will assist in the assuring that the polyurethane-isocyanate mixture flows throughout the rubber crumb layers. Additionally, it is possible to add some of the resin initially when the rubber crumb is added with the two being either mixed together or with the rubber crumb initially introduced into the mold followed by application of the liquid polyol/isocyanate mixture. As the mixture tends to set over time, the introduction of the resin components to the mold must be done in a relatively quick manner. For this reason it is preferred to introduce the material through various ports in the mold into the crumb rubber as soon as possible after the polyurethane and isocyanate components have been mixed together.

The preferred polyurethane forming components are those that provide low matrix or resin viscosities which in turn allow for the fast injection or introduction of the resin into the mold while providing good wetting of and penetration between the crumb rubber particles. The preferred resin system can be tailored to provide a reaction or working time of between about 5 and about 20 minutes as this enables the resin to completely fill in all spaces between the crumb particles and any openings in the core construction.

Once it is confirmed that the resin has been introduced throughout the rubber crumb particles, the mixture is allowed to cure for a sufficient period of time to form the encapsulation. The curing time will depend upon the reaction or working time and the temperature of the mold. The mold can be heated to accelerate curing if desired, but this is generally not necessary. The reaction between the polyol and isocyanate is an exothermic one and it also provides heat as well as resulting in an expansion of the material as cures. The fixing or clamping of the mold surfaces to prevent any outward expansion thus concentrates the expanding polyurethane material as a matrix in, around and between the rubber crumb particles in order to form a dense but compact encapsulation around all outer surfaces of the mat.

After the polyurethane has cured, the mold is opened by removing the top plate so that the mat can be removed from the mold. For this purpose, the lower mold surface can be provided with lifting pins or other known structures that will raise the formed mat above the bottom surface of the mold. This action combined with the draft angle provided on the sides of the mold frees the mat from being embedded in the mold and allows its removal. In some embodiments, the upper surface of the mat can be provided with lifting elements which are prevented from contacting the rubber crumb and polyurethane matrix forming mixture so that after curing of the resin and opening of the mold, these lifting elements are exposed to allow a hook from a crane or other lifting device to lift and extract the formed mat from the mold.

The molding process can be batch or continuous as desired. For a batch process, all operations are conducted on a single mold. After the mold release agents are added to the mold, a bed of rubber crumbs is initially laid in the mold well, the core construction is deposited on top of the bed of crumbs, and the additional rubber crumbs are added onto and around the core construction. The top mold surface is added and the entire unit would enter the press area where final forming would be done. After the press and curing operations are completed, the finished encapsulated mat can be removed from the mold.

An automated process is also possible. Several single molds are arranged on a circular track. A mold on a cart is provided with mold release at a first station; it then moves to a second station where an initial rubber crumb layer is added. The cart then moves to a third station where the mat is added. The cart next moves to a fourth station where additional rubber crumbs are added. The cart then is moved to a fifth station where the top mold surface is applied and the resin is introduced. The cart and fully loaded mold then moves to a sixth station where the press conducts the final forming and curing. Once out of the press, the encapsulated mat would be removed at a seventh station and the empty cart then moved back to the first station to start the process over again. Using seven carts allows the activities at each station to be conducted simultaneously and in a continuous manner on seven different molds.

The core construction housed within the encapsulation preferably comprises two or three layers: a central layer for strength and rigidity; and a layer of elongated members positioned above or below the central layer. Preferably, three layers are present. Suitable materials for the components of the upper, center and/or lower layers of the core construction include any of the materials mentioned in this application. Wood and preferably engineered wood is the most preferred due to the balance of a cost and desirable properties, but in addition, metal, thermoplastic and thermosetting materials, and elastomeric materials may be used. The elastomers are usually thermosets (requiring vulcanization) but may also be thermoplastic. These materials may be formed as elongated members or as sheet, grid or grating structures. While the encapsulation does protect the core construction from environmental conditions, the use of materials that are other than wood provides further benefits in case the encapsulation is breached or damaged.

It is also possible to use a metal plate or open metal structure as the center layer, either alone or with upper and/or lower sheeting or even as a reinforcement of a thermoplastic, thermosetting or elastomeric pad. Thus, the central layer can include multiple components that are assembled together to form the structure to which the upper and lower elongated members or boards are attached.

In a preferred embodiment, the core construction includes plural layers or plies of components at least some or all of which are wood or engineered wood. The woods that can be used in this mat include white oak or other hardwoods that are commonly included. The invention is also operable with pine or other softwoods as these are all protected by the encapsulation.

In addition to the wood core, the core of the mat can be made of environmentally resistant materials to provide additional performance advantages. This would include one or more elongated components or members of a thermoplastic, thermosetting plastic or elastomeric materials. These materials can be provided as a solid sheet or can optionally include apertures or open or closed cells therein or therethrough. An appropriately sized grating can be used if desired. These materials optionally reinforced to provide additional strength or stiffness. Alternatively, one or more elongated components or members of metal can be used.

For certain open cell or ladder frame core construction materials, reinforcement with wood, metal or plastic, the cells can be filled with other materials to provide the desired weight to the mat. Also, reinforcements of fabrics, sheets or other cell closing materials can be used to improve stiffness and strength of the layer and if necessary to retain the filler in the cells or openings in the construction core material.

When multiple components or members are provided, they would preferably be fastened or joined together using any acceptable technique, including the use of nails, rivets or bolts or even adhesives for wood or engineered wood members or components, the bonding of different plastic components or members together using plastic welding or the same or a different resin that is compatible for bonding those materials together, or by the welding or brazing of steel, aluminum or other metal components or members.

Preferred materials for the central layer of the core construction include:

various thermosetting materials, including Epoxy, Melamine formaldehyde (MF), Phenol-formaldehyde (PF), Polyester, Polyurethane (PU), Polyurea, Polyimide (PI), Silicone (SI) or Urea formaldehyde (UF). These materials can be reinforced with fibers or filler (carbon, glass, metal, etc.). These can be provided as a sheet, grid, grating, or array of beams, or pultruded tube that optionally can be filled with foam or other filler materials;

a thermoplastic material (any of the various plastics mentioned hereinabove) and in particular, HDPE, PET and SBR as disclosed in U.S. Pat. No. 6,380,309;

a honeycomb structure with filled cells and upper and lower plate surfaces that are molded or otherwise constructed, as disclosed in U.S. Pat. No. 8,061,929;

open face filled cellular structures of thermoplastics, polyolefins or vulcanized rubber as disclosed in U.S. Pat. No. 6,511,257;

molded sheets of thermoplastic resin as disclosed in U.S. Pat. No. 5,888,612; or a reinforced plastic composite material as disclosed in U.S. Pat. No. 4,629,358.

The edges of the core construction can be protected as disclosed in US patent 2014/0193196 or with wood or synthetic laminate to avoid mechanical damage to core edges. In the present invention, plastic or elastomeric materials can also be used. These can be molded onto the longitudinal sides of the mat or secured thereto as a separate component that is bolted or screwed onto the sides of the mat.

In a most preferred embodiment, the mat includes a core construction comprising a central layer made of a sheet, a plurality of elongated members, a plurality of compartments, or combinations thereof and the entire core construction is provided with the encapsulation. The core construction can also include one or both of an upper layer positioned above the central layer and a lower layer positioned below the central layer, wherein the upper and lower layers are each made of a sheet, a plurality of elongated members, a plurality of compartments, or combinations thereof.

Preferably, each layer includes a plurality of elongated members of wood or engineered wood with the elongated members having a thickness of not less than 0.75 inches nor more than about 12 inches and preferably between about 1 and 8 inches. For convenience in manufacture, all elongated members in the core construction would have approximately the same thickness.

Preferred materials for fiberglass reinforced plastic support structures that can be used as the core construction include various thermosetting materials, including Epoxy, Melamine formaldehyde (MF), Phenol-formaldehyde (PF), Polyester, Polyurethane (PU), Polyurea, Polyimide (PI), Silicone (SI) or Urea formaldehyde (UF). These materials can be reinforced with fibers or filler (carbon, glass, metal, etc.) as desired or necessary. And while glass mat, scrim or fabric is a common form of reinforcement, other conventional reinforcement materials can be used instead of glass or fiberglass. These additional reinforcements are included in the abbreviation "FRP." A convenient form of an FRP component is as a grating. For construction materials of FRP or metal that includes an open structure or openings therein or therethrough, the openings can optionally be filled or reinforced with wood, metal or plastic materials. The openings filled with these or other materials enables the support structure to provide the desired weight to the mat. Also, reinforcements of fabrics, sheets or other closing materials for such openings can be used to improve stiffness and strength of the support structure and if necessary to separately retain the filler in the openings.

It is also possible to use a metal plate or open metal structure as the support structure or center layer of the core construction, either alone or with upper and/or lower plies or layers of other materials. Thus, the structure can include multiple components that are assembled together to form the mat. The center layer can be used alone or it can include additional layers or plies of elongated components or members, such as upper and lower layers of wood or engineered wood boards.

When metal structures are used as the core construction or as a central layer of the core construction, the metal structures may include metal lath, metal sheet or metal structures or fabrications in the form of frames, ladders, etc. Openings are typically provided to reduce the overall weight of the mat. Steel, aluminum or stainless steel are typical metals for this use. To reduce the weight of the mat when the construction core it is made of metal, a honeycomb or lathe structure may be used, or as noted the construction core may be provided with a plurality of openings. For very open structures, the openings can be filled as noted above with a material that is lighter than the metal to maintain the weight of the structure at a desired level.

Any openings or open structures of the core construction can be covered with upper and/or lower sheeting to retain filler therein. Any material can be used for the sheeting as the metal core is providing the necessary strength and rigidity to the mat. Typically, the sheeting may be plywood, plastic, metal or composite material, and can be solid or in mesh form. The sheeting can be attached to the mat by bolting or by an adhesive. The sheeting and core can be maintained in position by being sandwiched between the outer layers, with the entire support structure held together by bolting. If necessary, holes for the bolts can be drilled through the metal plate or sheeting to facilitate assembly by allowing passage of the bolts therethrough.

And in a further embodiment of the invention, the provision of apertures or openings in the core construction enables the encapsulation material to be received therein, thus forming stronger bonding of the encapsulation to the mat as it not only encapsulates the outer surfaces of the mat but it also penetrates and passes through the openings of the core structure to join the top surface of the encapsulation to the bottom surface.

Preferably, the upper, central and lower layers of the core construction are nailed, bolted or riveted together.

Another preferred construction includes three layers of engineered lumber. Engineered lumber, also known as composite wood, man-made wood, or manufactured board; includes a range of derivative wood products which are manufactured by binding or fixing strands, particles, fibers, or veneers or boards of wood, together with adhesives, or other methods of fixation to form the composite material known as engineered lumber. These products are engineered to precise design specifications and tolerances which are much more controlled than ordinary wood products and meet various national or international standards and these controlled dimensions are carried over into the construction of the mat. Typically, engineered wood products are made from the same hardwoods and softwoods used to manufacture lumber.

There are three types of engineered wood that can be used in the present invention:

- parallel strand laminate (PSL), which is a beam that can be manufactured up to about 12×12 inches in any length due to the production of the beam by a continuous process;
- layered stand laminate (LSL), which is a billet that can be made at thicknesses of from about 1" to 4", in widths from about 2 inches to 54", and in lengths of about 8 feet to 64 feet; and
- layered veneer laminate (LVL) which is also a billet that can be made up to about 4 feet square by any length.

The preferred types of engineered lumber are laminated strand lumber (LSL) layered veneer laminate (LVL). The thickness of these lumber beams will be what is called 2×8 inches, which is actually approximately 1.75 inches thick but may be between 1.5 and 3 inches. Length can be as desired but will preferably be 12, 14 or 16 feet. The width of the LSL or LVL boards will vary depending upon location within the three layer mat. That is, width of the top and bottom layer boards will be approximately 8 inches (single width) or 16 inches (double width). Approximately means they may be slightly less such as 7.5 to 8.5 inches or 15 to 17 inches. Of course, as the LSL or LVL is manufactured, any particular thickness, width and length can be selected, but the preferred dimensions disclosed herein approximate those of conventional white oak mats which are in extensive use in the industry. A typical thickness for the mat is approximately 6" to 8", with the central layer providing a thickness of about 1" about 6" and preferably about 2 to about 4" and the upper and lower layers providing a thickness of about 1" to about 3". Of course, the dimensions can vary depending upon the specific end use intended for the mat.

The center layer will be approximately 4 to 8 feet by 12, 14 or 16 feet. The center layer may be made of LSL, LVL or other boards that are oriented perpendicularly to the boards of the top and bottom layers. The number of top, bottom, and center boards will be dictated by the final dimensions of the mat for the particular application or end use. When the center layer is a sheet or plate, the boards of the upper and lower layers can be oriented in the same or a different direction. Generally, for manufacturing simplicity, the boards of these layers are oriented to be parallel or perpendicular to each other. Other more complex angled board arrangements may also be used without departing from the teachings of this invention.

The engineering wood is preferred when close tolerances are required for the core construction. This is primarily necessary for preformed upper and lower encapsulation sections so that the mat can be assembled easily. As noted, after the core construction is placed between the upper and lower sections, the perimeter of those sections is sealed by welding or adhesives.

In another embodiment, the mat includes a core construction comprising a central layer, an upper layer positioned above the central layer and a lower layer positioned below the central layer, wherein each layer includes a plurality of elongated members of wood or engineered wood having thickness and width dimensions of approximately about 2" by about 8", and with each having a modulus of 1.6 M psi±20% up to about 2 M psi±20% and with the elongated members of the upper and lower layers oriented parallel or perpendicular to each other. Also, the core construction is made of materials that provide a load bearing capacity that is able to withstand a load of at least 600 to 800 psi without damaging or permanently deforming the core construction.

The core construction can include one, two or three layers as desired or necessary for a particular installation. The most preferred construction includes three layers as noted herein.

The core constructions may include those made of white oak as disclosed in U.S. Pat. No. 4,462,712 (three layer) and U.S. Pat. No. 5,822,944 (two layer), the entire content of each of which is expressly incorporated herein by reference thereto. Other wood species can be used as desired. Additional processing of the wood may be required to achieve the desired tolerances for optimum fitting of the construction core when encapsulation pieces are used.

An alternative embodiment relates to the provision of an encapsulation or coating of one or more of the environmentally resistant materials disclosed herein around a sheet, beam or board mat component of wood or engineered wood. The encapsulation or coating is applied prior to the assembly or incorporation of the component into the mat. The encapsulation or coating is applied to all exposed surfaces of the component so that moisture cannot get into the wood and eventually cause deterioration or rotting. The thicknesses would be the same as in other embodiments, namely, about 0.25 to about 0.5 inch or even as thick as about 1 or 2 inches or even more if desired for particular applications. A practical maximum is about 7 inches.

In a more general embodiment, the core construction housed within the encapsulation comprises two or three structural layers: a central layer for strength and rigidity; and a layer of elongated members positioned above or below the central layer. Preferably, three layers are present. Suitable materials for the components of the upper, center and/or lower layers of the core construction include any of the materials mentioned in this application. Wood and preferably engineered wood is the most preferred due to the balance of cost and desirable properties, but in addition, metal, thermoplastic and thermosetting materials, and elastomeric materials may instead be used.

When the frame members are made of steel, they can be simply welded together to provide the frame structure. Of course, if the frame members are made of FRP, they would be molded together or adhered together to form the frame structure of the mat. The plastic of the FRP pultrusions would be any one of the thermosetting plastics of the types mentioned herein but thermosetting polyesters and epoxies are preferred. When the frame members are made of wood, they can simply be bolted or riveted together. As noted herein, when different materials are used for the side and cross members it is also possible although not preferred to provide these members with an appropriate structure so that they can be bolted together.

The encapsulating structure is provided in any way that fills in all open spaces of the core construction as well as to provide the desired thickness on the top, bottom and outer side of the side members and the outer sides of the front and back cross members that form the frame. This can be done by placing the core construction in a mold and providing the encapsulating material within and upon the frame as it sits in the mold.

Alternatively, the encapsulation can be provided in other ways as noted, including but not limited to immersion coating of the entire core construction or by painting or otherwise depositing encapsulation material to completely encapsulate the core construction. The encapsulating material is typically a thermoplastic polymer, a thermosetting resin or an elastomeric material. For example, the entire core construction can be filled and coated with any of these materials to form a solid unitary mat structure.

Open areas in the core component, e.g., when it is a frame structure, may be filled with elongated members to reduce the amount of encapsulation material that is needed. These elongated members can be made of any of the materials disclosed herein, including wood, engineering wood, or FRP structures. Metal members can be used but these generally are more expensive than the other members mentioned in this paragraph and provide more strength that is necessary for the frame. Typically, wood members are used with treated pine being preferred from a cost standpoint. End grain wood sections can be provided for greater strength. Although these members are shown arranged to be perpendicular to the side members and wedged between them so that they are maintained in place during the application of the encapsulating material, these members can instead be oriented parallel or both parallel and perpendicular to the side members if desired. Also instead of wedging the boards in place, the can be bolted or adhered together before being bolted or adhered to the side members. Thus, when the encapsulating material is added it does not need to sill in the otherwise open spaced between the side and cross members.

Still further, it is possible to use a plate, sheet or mesh upon the upper and lower surfaces of the cross members so that foam, particulate matter, small particles of plastic or rubber including rubber crumb can be added to the areas between the plate, sheet or mesh to fill in those areas. When a mesh is used, this generally allows the encapsulating material to penetrate into those areas and fill in any interstices between the particles and form a completely solid mat which is a preferred arrangement of the present invention.

Also, the use of metal plate or sheet, for example, with the appropriate number of cross members enables the center areas of the core structure to remain open without reducing the compression strength of the mat. Typically, the sheeting may be plywood, plastic, metal or composite material, and can be attached to the mat by bolting or by an adhesive. The sheeting and core can be maintained in position be being encapsulated. For a more secure attachment, holes for the bolts can be drilled through the plate or sheeting to facilitate assembly by allowing passage of the bolts therethrough.

The encapsulation protects the frame construction from degradation due to weather conditions, typically moisture or water from rain or snow, as well as contact with oil, gas or other chemicals. If the mats are to be used in a particular chemical environment, the plastic materials can be selected for optimum resistance against that environment. Generally, however, the plastic material is one that can provide water and moisture resistance for the wood materials that are used for the frame construction. Also, the plastic material shall be chemically resistant to typical liquids found in the construction site. Thus, the mat will not absorb water or other liquid contaminates so that after cleaning or washing, the mat can be removed from the work site without transporting the liquid contaminates.

The thickness of the encapsulation can vary as desired. The top, bottom and outer side portions of the side members are provided by a predetermined thickness of at least about 0.25 or about 0.5 inch to as much as about 1 or 2 inches to as much as 5 to 7 inches of the material of the encapsulating structure. In certain embodiments, however, the thickness of the encapsulating material on the side and cross members can be as little as about 0.125 inch to as much as about 0.6 inch, especially when polyuria or polyurethane is used as the encapsulating material. Greater thicknesses, while not undesirable, are simply not necessary and add additional cost without additional benefits for that material. It is possible to provide a uniform thickness to facilitate manufacture of the encapsulated core construction.

While the encapsulation provides a unitary structure, in use it is envisioned that the encapsulation may eventually experience damage due to handling, installation and use in supporting heavy equipment or vehicles. While it sometimes is possible to patch or otherwise repair the damaged areas while still retaining a sealed structure that will resist moisture penetration, it is preferred to provide as an upper or lower surface of the mat elongated members that can protect the encapsulated core construction from such abuse.

As noted, the encapsulated core construction can be protected by the addition of elongated members on its top surface, bottom surface or on both surfaces to form upper and lower surfaces for the mat. The elongated members can be applied in a single layer wherein the members are arranged and spaced in longitudinal alignment with spacing between the members to allow drainage of moisture from the mat. Drainage channels are provided on the lower surface so that the mat will not slide when placed on muddy areas. The most preferred spacing between individual boards or components in the upper and/or lower surfaces is preferably approximately 1.25" wide to allow water to drain from the mat. The slip resistance of the mat is improved by the draining of the excess water, especially when use in locations that experience heavy rain or snow conditions. As noted, the boards can be arranged at any angle with regard to the sides or ends of the mat and the spacing directs the water to the ends or sides of the mat for drainage.

The lower surface can include elongated members that facilitate interlocking of one mat to an adjacent mat. The interlocking boards (e.g., boards 3, 6 and 9 of the single width construction and the three 6" boards of a double width construction) are provided on the lower surface of elongated members. They can be bolted or nailed onto the core construction through the encapsulation, but with appropriate sealing of the encapsulation with additional material to prevent water or chemical penetration into the core construction. This arrangement provides two additional benefits. First of all, the boards are easily replaceable if damaged while the protected reminder of the encapsulated core construction remains intact. Also, this arrangement facilitates the placement of lifting elements included in boards 3 and 9 of the single width construction or in the first and third 6" boards of the double width construction.

The upper and lower surfaces can include one or more layers of elongated members. When multiple layers are utilized, the elongated members are placed at an angle with respect to each other in adjacent layers. The most common arrangement is to provide the second layer orthogonally to the adjacent layers as this provides the greatest strength. Of course other angles can be used if desired. Typically, two or three layers is entirely sufficient to provide the best protection of the encapsulated core construction. And if desired, runners can be provided for additional protection of the elongated members or boards of the upper or lower surfaces.

When elongated members are used for the upper and/or lower surfaces, they can be configured in different ways:

a single width construction may be used where eleven 6" wide (by 12' 14' or 16' long) boards are provided in the upper and lower layers with three boards (nos. 3, 6, and 9) in the lower layer offset for interlocking; or a double width construction may be used where four 12" wide (by 12 or 16' long) boards are provided in the upper and lower layers: each one separated by a 6" board with the three 6" boards in the lower layer offset to provide interlocking.

The boards can be made of wood or engineered lumber (preferably with a tolerance of ±1/16") or they can be made of tubes of metal of a thermoplastic or thermosetting material, with pultruded thermosetting tube being one example of a preferred alternative material.

The boards can be attached to the mat using self-tapping lag screws or rivets. As the frame construction is precisely positioned in the mold, the points where the boards intersect is known. Thus, the interlocking boards can be attached to the mat by screwing or riveting into core construction. And as noted herein, if frame constructions are used, including those made of fiberglass reinforced plastic are used, the outer surfaces can be attached to the frame. If the frame construction is made of metal, it can be provided with bolting extending therefrom towards the top and bottom surfaces of the mat in the recesses to allow attachment of boards that are provided with holes to receive the bolts. The boards can then be secured to the mats using appropriate nuts and washers that engage the threaded ends of the bolts.

And while offsetting of certain boards is shown for providing an interlocking with adjacent mats, this is not always needed such that interlocking can be considered to be an optional yet desirable feature. Interlocking is often preferred to avoid staking of the mats to the ground or to avoid including other more complex components for use in connecting adjacent mats together. The interlocking boards are provided on at least the lower surface of the mat, but in certain embodiments, they can be provided on both the lower and upper surfaces of the mat as shown in the figures. And interlocking boards can be entirely omitted if desired, with the core construction including boards in all spaces prior to being encapsulated.

For greatest strength in any of the wood embodiments, most unidirectional veneers are oriented in the machine direction with 5 to 30% and preferably 20 to 25% of the veneers oriented in the cross machine direction. That geometry sets up some very impressive physicals for the combined structures. Furthermore, the costs of the structures of these embodiments will be on the order of oak or other hardwoods.

Preferred overall mat dimensions for wood mats are approximately 8' wide×6" tall and are either 12 ft, 14 ft or 16 ft in length. The interlocking feature will extend the length of the mats by about 1 ft at three locations at one end of mat. As noted, U.S. Pat. No. 4,462,712 discloses mats which contain interlocking fingers and recesses which are preferred for use in the present invention. The mats typically include three (3) layers of individual wood or engineered wood boards having cross section dimensions of 1.75" by 8".

All of the mats according to the invention are to be installed on properly prepared ground so that they will perform acceptably. Ground preparation must be on a uniform material of uniform flatness (i.e., within +/−12" over an 8'×14' surface). Crushed stone or rock no larger than 4" diameter is acceptable for preparing the ground as a substrate for supporting the mats.

All mats according to the invention are designed to meet the following product specifications for preferred implementations as temporary roadways, equipment support surfaces, platforms and similar applications. The mats of the invention do not cause contamination of the ground surfaces upon which they are applied.

Preferred overall mat dimensions are approximately 8' wide×6" tall and are either 12 ft, 14 ft or 16 ft in length. The interlocking feature will extend the length of the mats by about 1 ft at three locations at one end of mat. U.S. Pat. No. 4,462,712 discloses mats which contain interlocking fingers and recesses which are preferred for use in the present invention.

The number and size of the interlocking boards is not critical to the invention and typically, at least two or three boards (as shown) are provided. The width of the boards can be between 4 and 8 inches or in some cases larger or smaller as desired depending upon the overall size of the mat. For an 8 foot wide mat, the use of three or four 4 inch wide boards or alternatively three or four 8 inch wide boards would be suitable. In some situations, a lesser number of wider boards or greater number of less wide boards can be used. And as noted, the boards can be made of different materials such as wood, engineered wood, or an FRP pultrusion as long as it is possible to bolt or otherwise securely attach those boards to the mat. Bolting of course is preferred since it will allow replacement of the boards if they become damaged or deteriorated during use. The bolts can be provided as an extension from a cross member. In particular, when the cross members are made of metal, the bolts can be welded to the cross member and the boards can be attached to the mat by nuts which are secured to the bolts after the bolts pass through the boards.

The recesses that are provided on the bottom surface of the mat are as deep as necessary to accommodate the thickness of the boards. Typically a one or two inch thickness is sufficient with the recesses sized correspondingly. The recesses are not so deep as to contact the cross members and as noted the thickness of the encapsulation would be at least 0.25 or 1 inch on the cross member as well as beneath the boards. Appropriate configuration of the cross members is needed to achieve the overall tolerances and sizes of the mat and encapsulating structure thickness.

In certain specific applications, the upper surface and possibly the lower surface of the encapsulation structure can require additional layers for further extending the service life of the mat. To attach these additional layers, the cross and side members can be provided with appropriate bolting that extends through the encapsulating structure and allows attachments of the additional layers.

These optional additional layers generally include two (2) layers of individual wood or composite boards, having cross section dimensions of 1.75" by 8". These can both be on the top side of the mat or one layer can be on the top side and one on the bottom side so that the additional layers form the outer layers of the mat. The members of the additional layers would generally be joined together by bolting, nailing or riveting if made of wood or by other attachment means such as adhesives if made of FRP. They are also attached to the mat in a way that facilitates their replacement if damaged during use, with bolting again being the preferred method of attachment.

In another alternative embodiment, each board of the various layers of the mat are encapsulated with the material or a coating of one or more of the various materials mentioned herein. The encapsulation can be provided in other ways, including but not limited to immersion coating of each board or by painting or otherwise depositing encapsulation material to completely encapsulate the boards. Combinations of these techniques can be used as well, wherein a sheet or layer of the material is initially applied to the boards. Thereafter, the ends of the boards can be sealed with coating material and the overlapping edges of the sheet or layer sealed with an adhesive. Polymer sleeves can also be used with the ends of the sleeved folded upon the ends of the boards. Thus, each board will be protected from moisture as well as from abrasion due to traffic or equipment that passes over or is placed upon the mat. The outermost layers experience the greatest traffic and for that reason may be further provided with an additional surface coating of a material that provides additional abrasion resistance or with particles of various materials such as inorganic, rubber or plastic material to provide a non-slip surface. Crumb rubber can be used for this purpose. For environmental benefits, the crumb rubber can be obtained by grinding used automobile tires into the desired particulate size.

The provision of a encapsulation on the boards of the central layer protects that layer from moisture which would cause rotting or deterioration of the boards. This also enables the central layer to be reused if the boards of the outer layers require replacement.

When assembling the encapsulated boards into the mat, care should be used to close off any holes made for bolts or other attachment means. Bolts can be made of stainless steel or aluminum to prevent rusting while the holes through which they pass can be sealed off with a rubber gasket or O-ring placed beneath the bolt heads or nuts to make it more difficult for moisture to enter into the wood through the bolt holes.

Figure 2:
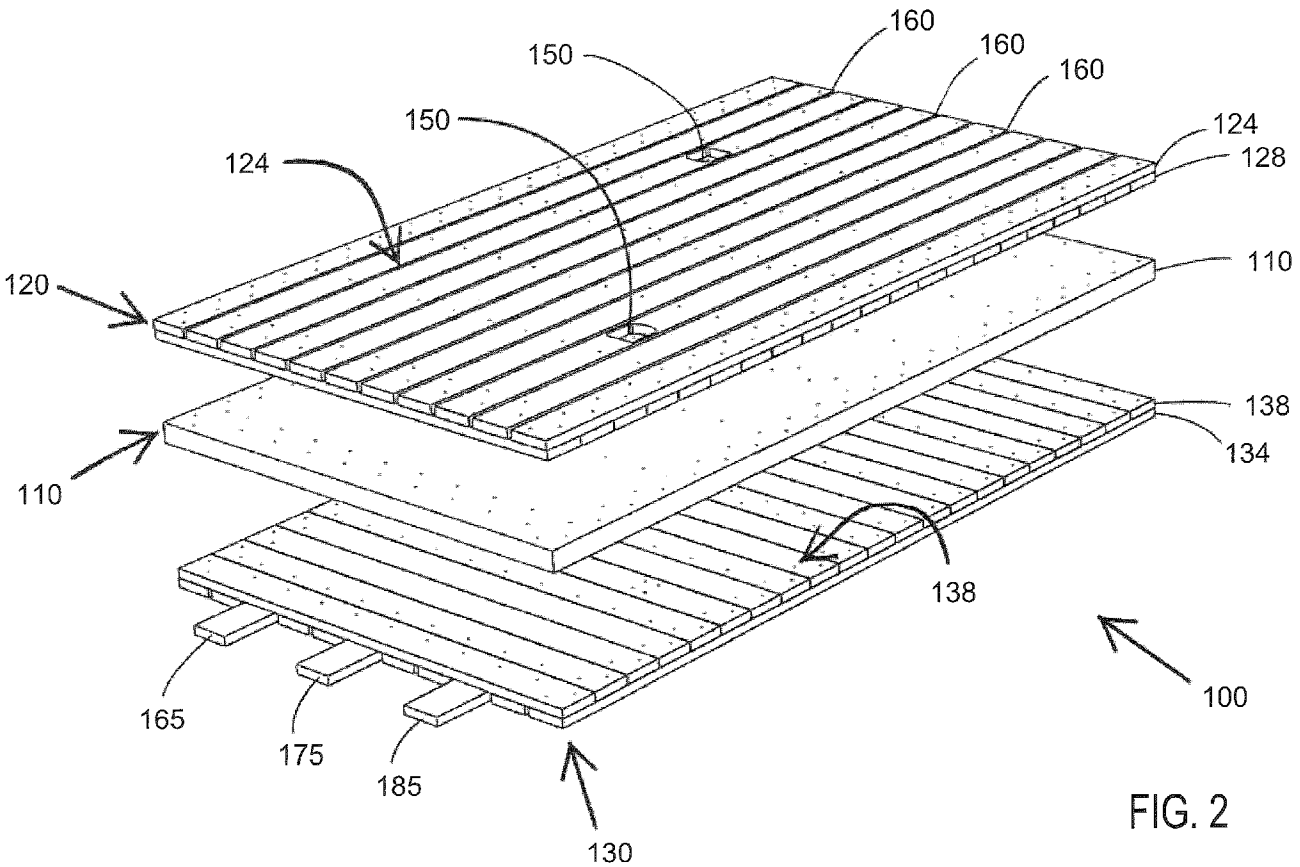
FIG. 2 is an exploded view of the mat of FIG. 1.

Referring now to the Figures, FIGS. 1-2 illustrate mat 100 having dimensions of about 8 feet wide by about 16 feet long and about 12 inches thick. The mat 100 includes an encapsulated core construction 110 that is about 4 inches thick and is present between two two-ply structures 120, 130 that include elongated members, preferably of wood. The structures include a first ply of longitudinal boards that form the upper 124 or lower 134 surfaces of the mat 100, and a second ply of transverse boards 128, 138 that extend across the width of the mat and are perpendicular to the longitudinal boards. The transverse boards 128, 138 support the longitudinal boards. The resultant two ply wood structure 120, 130 provide abrasion and impact resistance to the encapsulated core construction 110. The boards are typically about 2" thick and about 3" wide. As is known in the art, double width boards that are about 6" wide can instead be used to simplify the construction of the structures 120, 130.

The boards of the wood structures 120, 130 are attached to the core construction 110 by nailing, screwing, bolting or combinations thereof. When bolting is used, the bolts can extend from the boards of the upper surface 124 through the supporting boards 128 and through the encapsulated core construction 110 to the supporting boards 138 and boards 134 of the lower surface 130. The nails, screws or bolt heads and nuts are recessed below the top surface of boards 124 and below the bottom surface of boards 134 to present relatively smooth upper and lower surfaces of the mat 100.

Alternatively, the boards can be recycled materials of wood, plastic or an elastomer that are mixed with a binder and formed into elongated members or boards of the desired sizes. This creates an environmentally friendly mat, Also, any of these boards can be attached to the sheet 120 by an adhesive or other means that provide a secure attachment. Attachment of the boards in a manner that facilitates their future removal is preferred, however, so that the encapsulated core construction can be reused with the abuse boards replaced, Lifting elements 150 are provided on the third and ninth boards. These lifting elements 150 are configured as D shaped rings which are attached to the boards in recesses so that the lifting elements 150 can remain flat when the mat 100 is in use. Two lifting elements are shown but a skilled artisan can determine how many elements are needed for lifting of any particularly sized mat. If desired, lifting elements can also be provided on the boards attached to the lower skin portion 110 for versatility in the handling and transportation of the mat.

The lower surface 134 includes three offset board (i.e., the third 165, sixth 175, and ninth, 185 boards, respectively, to allow interlocking of the mat to an adjacent mat.

The boards of the upper 124 and lower 134 surfaces are spaced to provide water channels 160 that facilitate the drainage of water from the mat.

FIG. 2 illustrates the final shape and configuration of the mat 100 after assembly.

Figure 3:
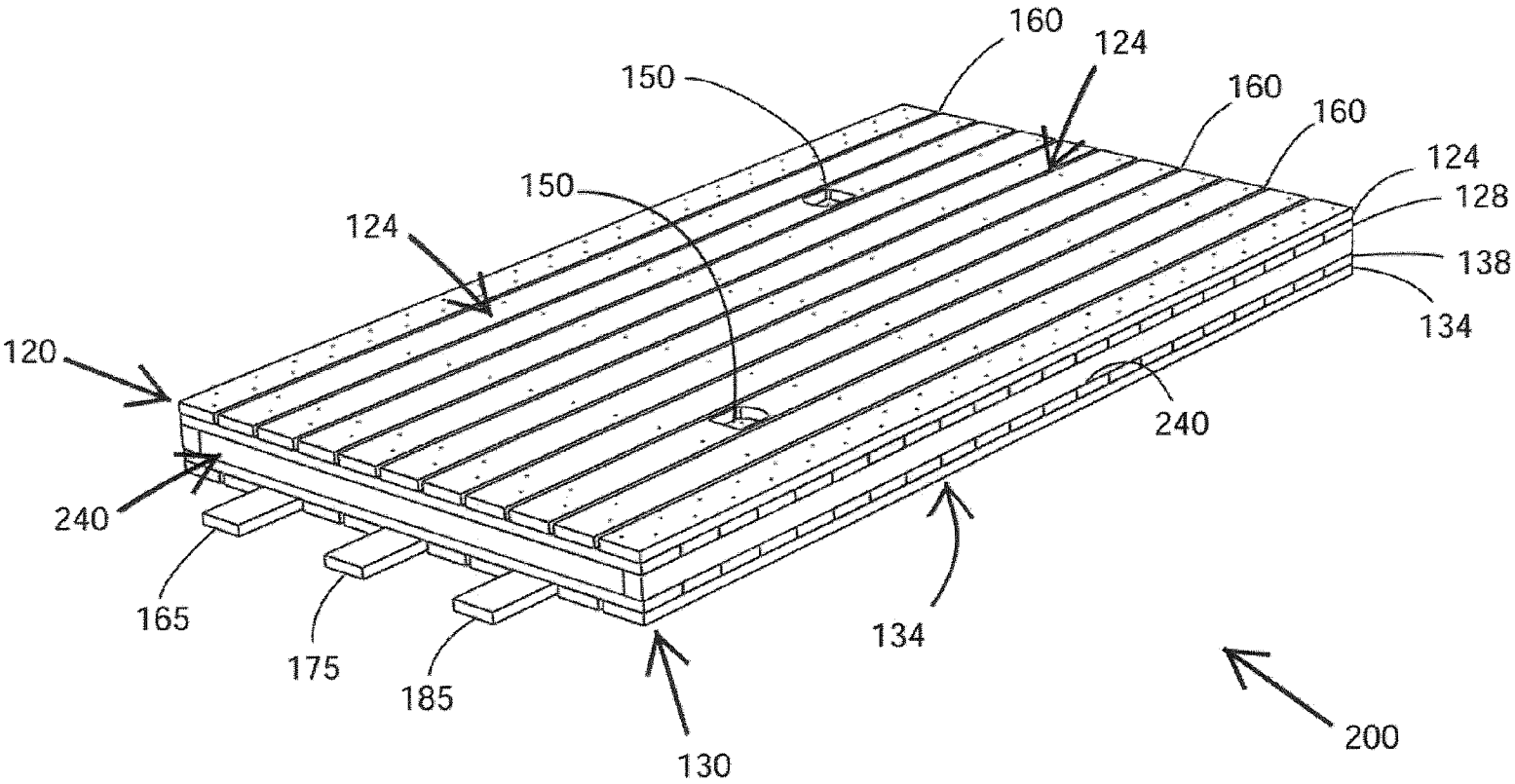
FIG. 3 is a perspective view of another industrial mat according to the present invention.

FIG. 3 illustrates another embodiment of a mat 200 in accordance with the invention that includes a peripheral structure 240 that can protect the encapsulated core construction. In this embodiment, like components to FIGS. 1-2 are labeled with the same numbers.

Peripheral structure 240 includes four elongated members which are approximately the same size as the encapsulated core construction 110. These four members, 240A, 240 B, 240 C, 240 D, surround the periphery of the encapsulated core construction 110 to provide impact resistance for the sides and ends of encapsulated core construction 110. These four members would typically be attached to form a frame that would surround the encapsulated core construction, but it would be easier to mount these members on either the upper 120 or lower 130 structures. For example, the longitudinal members 240A, 240D can be attached to the upper structure 120 while lower structure 130 can include end members 240 B, 240 C. These four members protect the encapsulated core construction 110 from side impacts for example from forklift tines, to extend the life of that construction. In the event that these members are damaged, they can be replaced with the core construction reused in the mat.

Figure 4:
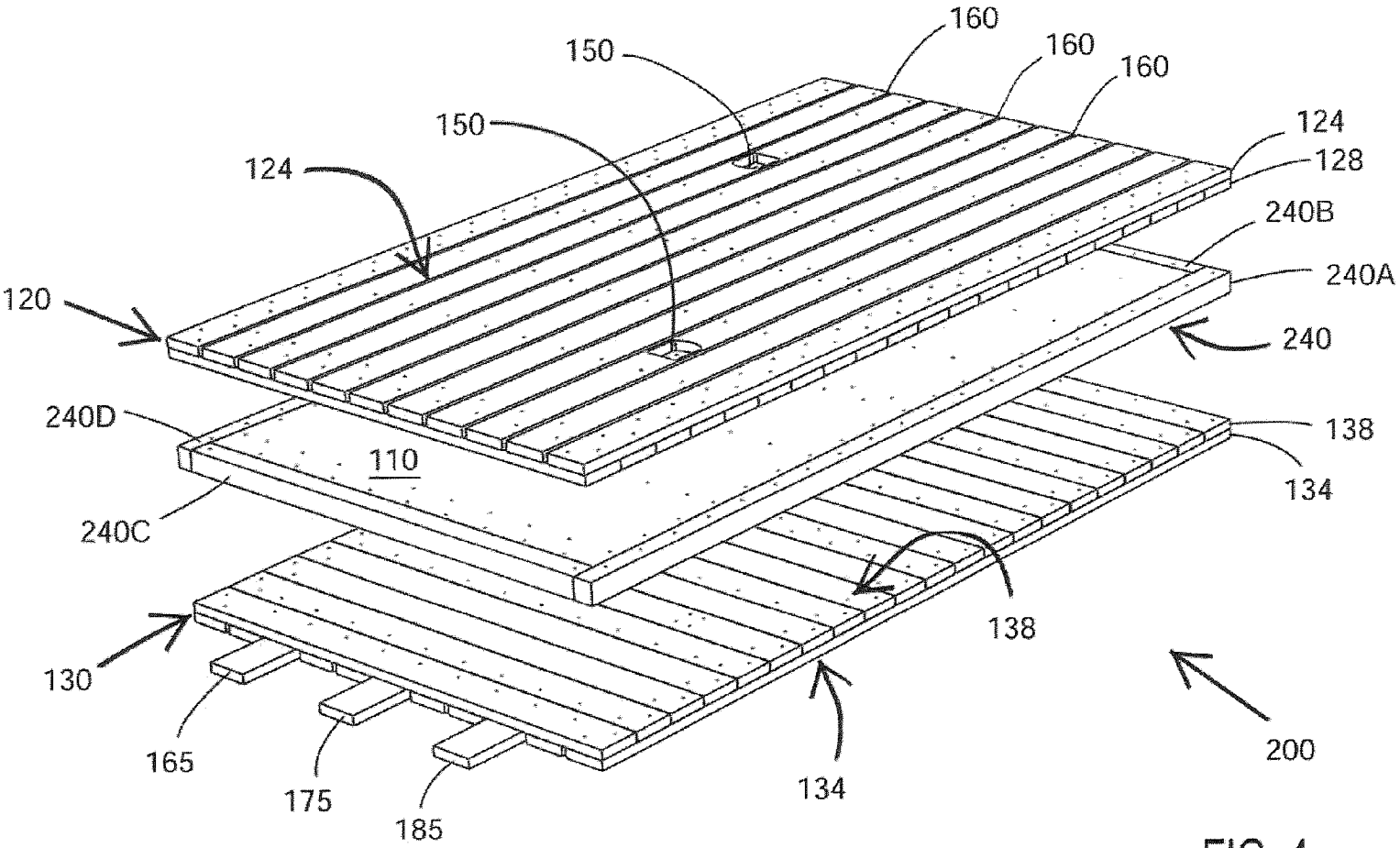
FIG. 4 is an exploded view of the mat of FIG. 3.

FIG. 4 illustrates the final shape and configuration of the mat 200 after assembly.

Figure 5:
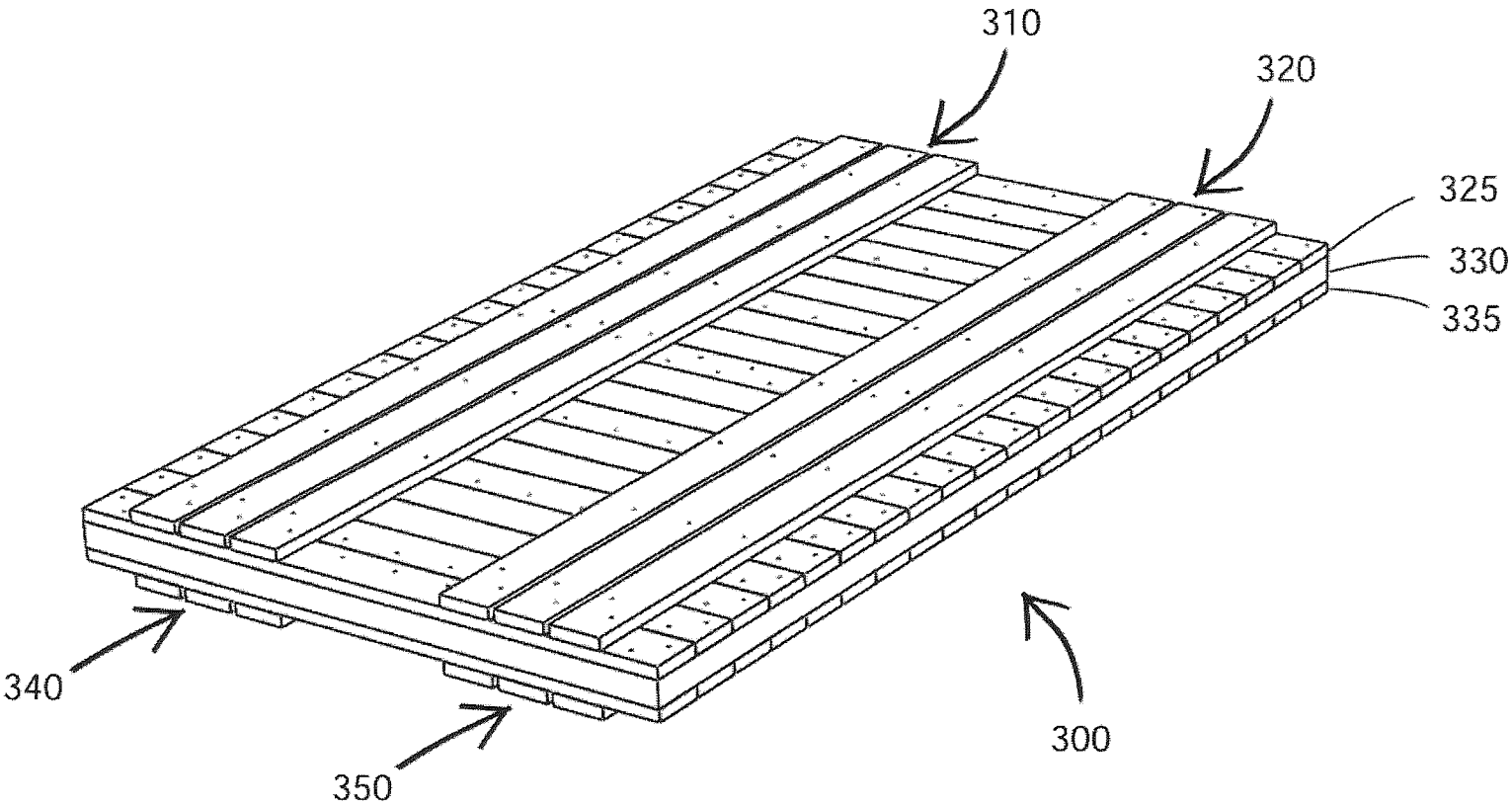
FIG. 5 is a perspective view of a mat that is provided with runners that allow trucks to traverse the mat without directly contacting the upper surface.

FIG. 5 illustrates a mat 300 according to the present invention that includes runners 310, 320 located on the upper surface 325 over a single layer of elongated boards that are applied transversely onto the encapsulated core structure 330. The underside of the mat beneath the encapsulated core structure 330 includes a similar structure of elongated boards 335 and runners 340, 350. This allows either side of the mat to be used as the top surface. Alternatively, the bottom of the mat can include two layers of elongated boards with the lower surface extending completely across the entire mat.

Figure 6:
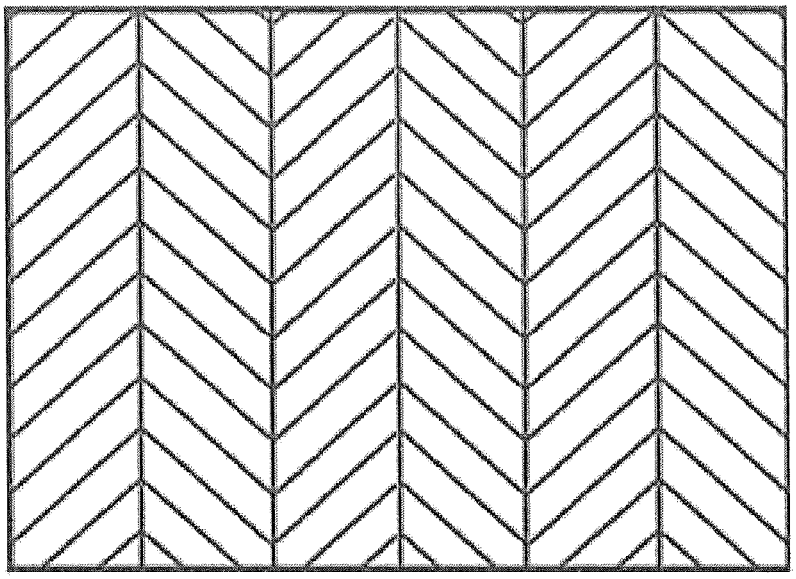
FIG. 6 is an illustration of a chevron pattern for arranging elongated members on the upper or lower surface of the mat.
Figure 7:
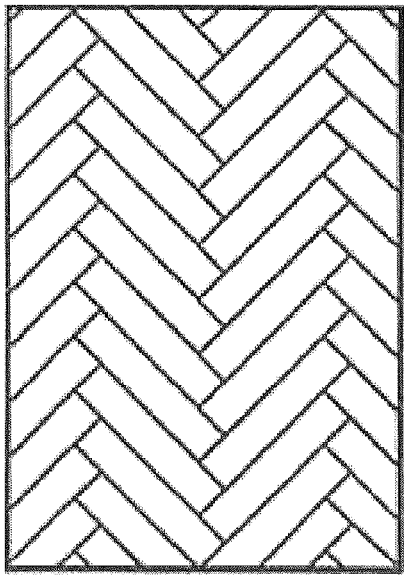
FIG. 7 is an illustration of a herringbone pattern for arranging elongated members on the upper or lower surface of the mat.

And while the boards for the runners are shown as being arranged along the longitudinal length of the mat, these boards can be arranged in at an angle, transversely, or in a chevron or herringbone pattern. These patterns are shown in FIGS. 6 and 7, and they can be used for the upper and or lower surfaces of the mat or just for the runners shown in FIG. 5. As noted herein, these boards or elongated members can be oriented at any angle on the mat depending upon the intended use or the desire of the user of the mat. Generally, however, when angled, the boards would be arranged at an angle of between 25 and 75 degrees, e.g., 30, 45 or 60 degrees, while it is even more common to arrange them in a longitudinal or transverse fashion (i.e., 0 or 90 degrees). Accordingly, a skilled artisan has a wide variety of options for the specific configuration of the upper and lower surfaces of the mat as well as any runners that may be provided thereon.

The upper and lower layers surfaces of the mat may be a single layer of boards, a double or triple layer of boards or elongated members, or even a complete two or three ply mat construction which is added to the top and or bottom of the encapsulated core construction. It is also important to note that the upper and lower surfaces of the mat do not have to be uniform and one can contain more layers or plies then the other while still achieving the benefits of the present invention. Usually, the mat construction is symmetrical so that it can be used with either surface as the top. This also facilitates greater service of the mat since the surface in better condition can be used as the top surface when being installed.

While offsetting of certain boards is shown for providing an interlocking with adjacent mats, this is not always needed such that interlocking can be considered to be an optional yet desirable feature. Interlocking is often preferred to avoid staking of the mats to the ground or to avoid including other more complex components for use in connecting adjacent mats together.

Another feature of the invention is the use of color coding to identify the core construction of the mat. As the encapsulation is opaque, it is not possible to visually determine how the core is made. Thus, a color coding system can be used to identify the specific core construction. This can also be used to identify mats for a particular customer or end user. When mats are rented or leased, the color coding can be used to identify which mats belong to the leasing company compared to mats provided by others. The color coding can be of a single color or of certain stripes, patterns, dots or other indicia that provides a "signature" that identifies the specific core that is present in the mat or a particular end user or owner of the mat.

All of the mats according to the invention are to be installed on a prepared ground surface so that they will perform acceptably. Ground preparation is typically upon a material of uniform flatness (e.g., within +/−12" over an 8'×14' surface). Crushed stone or rock generally no larger than 4" diameter is acceptable for preparing the ground as a substrate for supporting the mats.

All mats according to the invention that include the most preferred core construction or alternatives thereof are designed to meet the following product specifications for preferred implementations as temporary roadways, equipment support surfaces, platforms and similar applications. A further benefit of the mats of the invention is that they do not cause contamination of the ground surfaces upon which they are applied.

Preferred overall mat dimensions are approximately 8' wide×6" tall and are either 12 ft., 14 ft. or 16 ft. in length. The interlocking feature will extend the length of the mats by about 1 ft at three locations at one end of mat. U.S. Pat. No. 4,462,712 discloses mats which contain interlocking fingers and recesses which are preferred for use in the present invention.

The mats typically include three (3) layers of individual wood or composite boards, having cross section dimensions of 1.75" by 8" and having a length that corresponds to that of the mat. If desired or necessary, smaller lengths can be used and placed end to end to cover the entire length of the mat.

The spacing between individual boards or components in the upper layer is preferably approximately 1.25" to allow water to drain from the mat. The slip resistance of the mat is improved by the draining of the excess water, especially when use in locations that experience heavy rain or snow conditions.

The preferred mats have physical properties that meet or exceed the physical properties of a conventional white oak mat.

The mat must also provide sufficient load bearing capacity: a fully supported mat (one that is properly installed on an approved ground surface preparation) must withstand a 10 ton load, spread over a 12" diameter surface without degradation of mat properties or permanent deformation of core construction of the mat. The core would have a crush resistance of between about 600 and 800 psi depending upon the application. This provides resistance against compression while not detracting from providing resistance to torsion forces that applied to the mat by vehicles passing thereover.

The core construction of the mat preferably is not hollow. If hollow components are used for the various layers of the core construction, such as metal lath, metal sheets with openings provided therein, thermoplastic or fiberglass reinforced thermosetting plastic structures with open or closed cells, or the like, the openings or cells may preferably be filled with a non-absorbent material. A wide variety of different plastic, elastomeric or foam materials can be used for this purpose. The hollow portions can be used as is or can be provided with filler or other materials to increase or decrease weight as needed. Fillers of glass, ceramic or metal particles can be included to provide additional weight or strength to the mat. Other materials such as recycled rubber tire material or other environmentally friendly materials can instead be used. Preferably, the mat has a weight that is on the order of a white oak mat of similar size.

For a more advanced product, the core construction layer may be made of environmentally resistant material to further prevent against degradation due to weather conditions in the event that the encapsulation becomes damaged or otherwise compromised to allow liquid to enter into the core construction.

The term "environmentally resistant material" means a material that is not subject to deterioration by water, moisture or other environmental conditions when compared to a conventional wood material such as white oak that is commonly used for such mats. This term includes thermoplastic and thermosetting materials as disclosed herein along with elastomers and even metals such as steel, aluminum or stainless steel. While steel does rust when encountering moisture or water, this is not considered to be a deterioration of the material as it is a surface phenomenon that does not affect the physical properties of the material but instead just detracts from its surface appearance. To avoid this, the steel components can be coated or painted to provide a better appearance and even further environmental resistance. Under certain conditions treated wood can withstand rotting and degradation much better than untreated wood such that it would be considered to be an environmentally resistant material because of it improved resistance against rotting.

Preferably, the encapsulation is relatively non-flammable. Flammability of mat is defined as Class 2 (B) flame spread when measured by ASTM E84 test criteria. The flammability properties of the encapsulation materials can be enhanced by adding the appropriate conventional flame retardant or other additives that are known to impart such properties.

The encapsulation should also allow dissipation of static electricity. For this purpose, the encapsulation can include carbon black, metal particles or other conductive fillers.

To prevent premature deterioration of the encapsulation, the material for the encapsulation should contain UV inhibitors as necessary and in an amount sufficient to reduce deterioration of physical properties or color.

To assist in gripping of vehicle or personnel traffic on the mat, a non-slip or textured surface can be applied to the exposed surface of the encapsulation. This can be sand or other grit material that is embedded in the encapsulation during preparation or molding or that is later added with an adhesive or a coating.

For ease in moving of the mats, attachment points can be provided that allow for lifting and handling of individual mats. Lifting hardware preferably includes D rings, O-rings, chain, or cables at 2-4 locations on the upper surface of the mat. The exact position and attachment of lifting hardware is designed based on the size and weight of the mat and is intended to avoid damage to the encapsulation or the internal structure of the mat.

Optionally and preferably, the mats of the invention may also include bumpers which protect the sides and/or ends of the mat from damage during transport and installation. These bumpers are generally configured as a rails, rods or beams of a material that protects the sides and ends of the mat from damage when being moved around from warehouse to truck to jobsite. As the mats are relatively heavy, they are moved by heavy equipment such as front end loaders or cranes, and are typically dragged or dropped into position. The bumpers also provide protection to the side edges of the mats due to such movements and manipulations as well as some resistance to penetration by teeth or tines of the moving equipment. The bumpers also prevent or reduce damage to the encapsulated core construction from side entrance or egress onto the mat from large vehicles with steel tracks. The bumpers are preferably removable so that they can be replaced when damaged. They typically are made of wood, metal, or a plastic or elastomeric material and can be added onto the sides and/or ends of the mat.

In a preferred embodiment, the bumpers are made of a durable, tough and resilient material such as a plastic or elastomer, in particular, HDPE or a rubber material having a Shore D hardness of 10 to 50 is preferred. The bumpers are preferably molded or extruded into the desired shape or shapes for releasable attachment to the mat. The bumpers are preferably located on the longitudinal sides of the mat but they may be provided on all sides of the mat. The bumpers provide protection to the mat as well as to avoid damage to the plastic or elastomeric components of the layers that utilize those materials.

A number of additional features may be provided in the mats of the present invention. A radio frequency identification (RFID) tag can be embedded into the access mats in a routered pocket in the core construction to enable the access mats to be monitored in an inventory system or when rented for use. The tag provides a unique identification serial number for each mat, such that the mats which are being used or rented can be tracked and accounted for as to location of use. The mats can be scanned when in a warehouse, when loaded on trucks for delivery, when delivered to a job site, or when collected from a job site after use. The RFID tags can be active or passive and if desired, other tracking devices such as barcodes could similarly be for the same purposes. It is preferred, however, that the RFID tag be embedded in the mat so that it is protected from damage by the encapsulation. When a barcode or other surface mounted tag or indicia is used, it should be placed on a surface portion of the mat that is less likely to experience wear or abuse. Thus, the tag may preferably be applied onto the side of the mat so that it is not directed exposed to traffic on the mat.

In order to manipulate the mats for loading/unloading, or moving from one location to another or for installation and retrieval, the mats can include a retractable lifting element. This can be the lifting elements described above and those elements lie in a recess in the top surface of the mat during use for ease of access and to prevent tripping or damage to items moving over the mat or damage to the lifting elements themselves. Alternatively, a more complicated design such as that of US patent publication 2008/0292397 can be used.

To assist in the use of the mat during the night or on days that are dark due to poor weather conditions, the mat may include one or more lighting elements, such as those disclosed in International application WO 2006/048654. These lighting elements would preferably be embedded in the encapsulation. The encapsulation can be provided of clear plastic, so that the lighting element may be positioned below the encapsulation for better protection of the lighting element during use. As the embedding of the lighting element below the encapsulation surface can result in reduced luminosity, a skilled artisan can best determine the appropriate location for the placement of the lighting element in or under the encapsulation and for providing the encapsulation of the appropriate color or clarity to achieve the desired lighting brightness. This can also be adjusted by providing a larger number of lighting elements or of lighting elements of larger size.

The present invention provides unexpected benefits over the art in that the elongated members form upper and lower surfaces for the mat and provide resistance to abrasion and abuse of the encapsulated core construction while the encapsulation prevents moisture, water or chemicals from the surrounding environment from penetrating into the core construction.

Additionally, the mats have anti-static properties and provide traction and anti-skid surfaces depending upon the finish of the elongated members. These can be provided with a coating that contains particulate matter of any type of inorganic particles or plastic or rubber pellets to provide an anti-skid surface. The amount of particles would depend upon the size and can be determined by routine testing depending upon the material use for the coating. Also, certain materials such as rubber, when present as a coating or in the elongated members, act as a heat sink to allow ice to melt more quickly from the mat which is a safety feature when the mats experience snow and ice conditions in winter. The elongated members of the mats can also be pigmented to be place to assist in absorbing sunlight to melt ice or snow.

All of these features contribute to the ability of the mat to provide a much longer service life compared to when wood components are used alone since the encapsulation prevents rotting or other chemical degradation of the wood components of the core construction and the elongated members provide impact, abrasion and abuse resistance as well as protection for the encapsulation. Further enhancements in service life if desired can be expected by providing a core construction made of thermosetting or thermoplastic materials or plastic coated metal. To the extent that any of the elongated components of the upper or lower surfaces are damaged, they can be replaced so that a new mat can be made with the reuse of a substantial part or all of the core construction, thus providing savings in recycling rather than replacing the mat.

What is claimed is:

1. An industrial mat comprising:

a core construction that provides strength and rigidity to the mat;

an encapsulation of a durable skin of a thermoplastic, thermosetting or elastomeric material or a mixture thereof that surrounds and encapsulates the core construction, with the skin forming top and bottom surfaces about the core construction and having a thickness sufficient to provide environmental resistance to the core construction that it encapsulates; and an upper surface formed by a plurality of elongated members positioned above the encapsulated core construction, a lower surface formed by a plurality of elongated members positioned below the encapsulated core construction, or both of the upper and lower surfaces, wherein the elongated members of the upper and/or lower surfaces are arranged in spaced relation in at least one layer and are attached together or to the core construction for protecting the durable skin from abrasion and impact during transport, installation and use of the industrial mat;

wherein the industrial mat has a load bearing capacity that is able to withstand a load of 600 to 1000 psi without permanent deformation.

2. The mat of claim 1, wherein the core construction comprises:

(a) at least one layer or ply of a wood or engineered wood sheet member or of wood or engineered wood elongated components that are fastened or joined together, or (b) a layer or ply of a thermoplastic material in the form of a plurality of adjacently arranged elongated members or a sheet member that optionally includes open or closed cells therein or therethrough, or (c) a thermosetting plastic support structure in the form of a plate, beam, grid, grating, ladder or pultruded tubes, or (d) a metal support structure in the form of beams that are welded together to form a frame or ladder structure, or a plate that optionally contains apertures therein, or (e) at least two layers or plies of elongated, sheet, plate, beam, grid, grating, ladder or tube members wherein the layers or plies are fastened or joined together.

3. The mat of claim 2, wherein the core construction includes a central layer of one of (a), (b), (c) or (d), and either an upper layer positioned above the central layer or a lower layer positioned below the central layer or both upper and lower layers, wherein each upper and/or lower layer is attached to the central layer and includes a plurality of elongated members of wood or engineered wood, each elongated member having a modulus of at least about 1.6 M psi.

4. The mat of claim 1, wherein the encapsulated core construction has a length and width that is smaller than that of the mat by about 4 to about 16 inches so that the encapsulated core construction is recessed from an end, side or both end(s) and side(s) of the mat.

5. The mat of claim 1, wherein the encapsulation has a minimum thickness of about 0.25 inch and a maximum thickness of about 0.5, about 1, about 1.5, about 2, about 3, about 4, about 5, about 6 or about 7 inches.

6. The mat of claim 1, wherein the encapsulated core construction has a length and width that substantially corresponds to that of the mat, and has an overall thickness of not less than about 0.75 inches and not more than about 16 inches or between about 1 and about 8 inches or between about 1.5 and about 4 inches.

7. The mat of claim 5, wherein the core construction is made in multiple sections that when placed adjacent each other have an overall length and width that substantially corresponds to that of the mat.

8. The mat of claim 1, wherein the encapsulation comprises a thermoplastic material of polyethylene, polypropylene, polybutylene or a thermoplastic polyurethane, a thermosetting material of a polyurethane, or an elastomeric material of a vulcanized rubber material.

9. The mat of claim 1, wherein the encapsulation comprises a mixture of an elastomeric material and a polyurethane resin, wherein the elastomeric material comprises crumb rubber particles embedded in a matrix of the polyurethane resin, with the crumb rubber particles comprising at least about 55 to about 80% by weight of the encapsulation and the polyurethane comprising about 20 to about 45% by weight of the encapsulation.

10. The mat of claim 1, wherein the elongated members comprise boards, sheets or plates of wood, engineered wood, a thermoplastic, a thermosetting plastic, an elastomer or a recycled material of any of the foregoing with a binder; and wherein the elongated members are bolted, riveted or screwed to the core construction.

11. The mat of claim 10, wherein the elongated members of the upper surface, the lower surface, or both the upper and lower surfaces are arranged in a spaced longitudinal arrangement in an outermost layer to form a plurality of channels or grooves therein that provide traction to objects moving on the upper surface of the mat and/or resistance to mat slippage when the lower surface of the mat is placed on wet or muddy ground surfaces.

12. The mat of claim 11, wherein the channels or grooves are about 0.5 to about 2 inches wide, about 0.25 to about 2 inches deep and extend longitudinally along the mat.

13. The mat of claim 10, wherein the upper surface, the lower surface or both the upper and lower surfaces include multiple layers or plies of elongated members.

14. The mat of claim 1 wherein the elongated members of the upper or lower surface are arranged longitudinally along the mat, transversely across the width of the mat, at an angle with respect to the sides or ends of the mat or in a chevron or herringbone pattern.

15. The mat of claim 1 wherein the upper surface, the lower surface or both of the upper and lower surfaces of the mat further comprises runners of a plurality of elongated members configured and arranged longitudinally along the mat, transversely across the width of the mat, at an angle with respect to the sides or ends of the mat or in a chevron or herringbone pattern to allow wheeled vehicles to travel on the runners without directly contacting the elongated members of the upper or lower surfaces so that the runners can be replaced when necessary without having to replace the elongated members of the upper or lower surfaces of the mat.

16. The mat of claim 4, wherein one of the upper surface or the lower surface includes elongated members attached thereto that are of the same thickness as the encapsulated core construction and that are located along the periphery of the mat at a front end thereof, a back end thereof, one or both sides thereof or on combinations of or all of the front end, back end and sides of the core construction to provide a peripheral structure to protect the encapsulation from side and/or end impact.

17. The mat of claim 6 further comprising bumper members located along the periphery of the mat at a front end thereof, a back end thereof, one or both sides thereof or on combinations of or all of the front end, back end and sides of the core construction and connected thereto to protect the encapsulation from side and/or end impact.

18. The mat of claim 1 having a width of between about 2 and about 12 feet, a length of between about 2 and about 40 feet and an overall thickness of between about 2 and about 18 inches.

19. The mat of claim 1 further comprising one or more lifting elements attached to the upper surface, the lower surface, or to each surface, with the lifting elements comprising D-shaped members, O-shaped members, U-shaped members, hooks, or circular or polygonal rings having sufficient strength to provide certified overhead lifting of the mat for installation and reclamation thereof.

20. The mat of claim 1 wherein the elongated members are present on the lower surface in spaced relation both with respect to each other and with respect to the one end of the mat to facilitate interlocking of one mat to an adjacent mat.

21. The mat of claim 20 wherein three elongated members are present on the lower surface to facilitate interlocking of one mat to an adjacent mat.

22. The mat of claim 1, further comprising a radio frequency identification (RFID) tag to enable the mat to be monitored in an inventory system or when rented for use.

23. The mat of claim 1, further comprising lighting elements that provide light to assist in the use of the mat during the night or on days that are dark due to poor weather conditions.

24. The mat of claim 1, further comprising color coding to identify the construction of the mat or to identify mats for a particular customer, end use or to indicate that the mat is rented or leased.

25. The mat of claim 17, wherein the bumper members are in the form of rails, rods or beams of a high density polyethylene (HDPE), rubber having a Shore D hardness of 10 to 50, or a fiberglass reinforced thermoplastic plastic.

* * * * *